US008676069B2

(12) United States Patent
Fujii

(10) Patent No.: US 8,676,069 B2
(45) Date of Patent: Mar. 18, 2014

(54) IMAGE FORMING APPARATUS

(75) Inventor: Koji Fujii, Osaka (JP)

(73) Assignee: Kyocera Mita Corporation (JP)

( * ) Notice: Subject to any disclaimer, the term of this patent is extended or adjusted under 35 U.S.C. 154(b) by 252 days.

(21) Appl. No.: 13/115,357

(22) Filed: May 25, 2011

(65) Prior Publication Data

US 2011/0293303 A1 Dec. 1, 2011

(30) Foreign Application Priority Data

May 28, 2010 (JP) ..... 2010-123449
May 28, 2010 (JP) ..... 2010-123450
May 28, 2010 (JP) ..... 2010-123451

(51) Int. Cl.
*G03G 15/00* (2006.01)
*G03G 15/16* (2006.01)
*G03G 15/01* (2006.01)

(52) U.S. Cl.
USPC ..... 399/49; 399/66; 399/302

(58) Field of Classification Search
USPC ..... 399/49, 74, 66, 72, 302
See application file for complete search history.

(56) References Cited

U.S. PATENT DOCUMENTS

2002/0027669 A1* 3/2002 Nagatomi et al. ..... 358/1.9
2009/0190971 A1 7/2009 Inui et al.

FOREIGN PATENT DOCUMENTS

JP 2007272158 A * 10/2007
JP 2008-304596 12/2008
JP 2009025473 A * 2/2009
JP 2009169296 A * 7/2009
JP 2009-175581 8/2009

OTHER PUBLICATIONS

Machine translation of Takayanagi, JP 2009-025473.*

* cited by examiner

*Primary Examiner* — David Gray
*Assistant Examiner* — Sevan A Aydin
(74) *Attorney, Agent, or Firm* — Gerald E. Hespos; Michael J. Porco; Matthew T. Hespos

(57) ABSTRACT

A multifunction peripheral includes: development units of respective colors; an intermediate transfer belt; a transfer roller; a movement mechanism that moves the intermediate transfer belt in a direction of coming in contact with and separating from a magenta development unit and the like; a concentration sensor; a control part that causes the magenta development unit and the transfer roller to form a toner pattern on the intermediate transfer belt; and a determination unit that determines that the pressing state of the magenta development unit and the like and the intermediate transfer belt is normal when the toner pattern concentration detected by the concentration sensor after the toner pattern is transferred to the intermediate transfer belt has reached a predetermined concentration value.

9 Claims, 24 Drawing Sheets

IMAGE FORMING APPARATUS

BACKGROUND OF THE INVENTION

1. Field of the Invention

The present invention relates to an image forming apparatus, and in particular relates to technology of determining whether the pressing state of an intermediate transfer belt and a mechanism which performs the transfer of toner images to and from the intermediate transfer belt is normal.

2. Description of the Related Art

Conventionally known is an image forming apparatus of a system which temporarily transfers a toner image formed with a development unit including a photoreceptor drum to an intermediate transfer belt, and further transfers the toner image on the circumferential surface of the intermediate transfer belt onto recording paper based on a secondary transfer roller. This kind of image forming apparatus includes, for example, a movement mechanism for causing a photoreceptor drum, which forms a part of the development unit to rotate in a direction of pressing against and separating from a circumferential surface of an intermediate transfer belt, a pressing/separation motor for applying rotational driving force to the movement mechanism, a drive control part for controlling the drive of the pressing/separation motor, and a pressing state sensor for detecting a state of the photoreceptor drum pressing the circumferential surface of the intermediate transfer belt. The drive control part drives the pressing/separation motor and causes the movement mechanism to transfer the intermediate transfer belt toward the photoreceptor drum so that only the black development unit presses the intermediate transfer belt during black-and-white image formation, and all development units of the respective colors presses the intermediate transfer belt during color image formation, and, at the point in time that the pressing state sensor detects a state where the circumferential surface of the intermediate transfer belt is being pressed by the photoreceptor drum, the drive control part stops the pressing/separation motor, and image formation is performed to the recording paper in this pressing state.

SUMMARY OF THE INVENTION

The present invention is a further improvement of the foregoing conventional invention. Specifically, the present invention is an image forming apparatus including a development unit that forms a toner image; an intermediate transfer belt including a circumferential surface to which the toner image formed by the development unit is transferred, a transfer unit that transfers the toner image from the development unit to the intermediate transfer belt, a first movement mechanism that moves the intermediate transfer belt in a direction of coming in contact with and separating from the development unit, and pressing the intermediate transfer belt against the development unit, a first control part that causes the development unit to form a toner pattern and causing the transfer unit to transfer the toner pattern to the intermediate transfer belt in a state where the intermediate transfer belt is pressed against the development unit by the first movement mechanism; a toner pattern concentration detection unit which is provided more downstream in a toner image transport direction of the intermediate transfer belt than a nip part of the intermediate transfer belt and the development unit that has transferred the toner pattern to the intermediate transfer belt, and which detects a concentration of a toner pattern being a concentration detection toner image that has been transferred from the development unit to the circumferential surface of the intermediate transfer belt; and a first determination unit that determines that a pressing state of the development unit and the intermediate transfer belt moved by the movement mechanism is normal when, after the toner pattern is transferred to the intermediate transfer belt based on the control by the first control part, the concentration of the toner pattern detected by the toner pattern concentration detection unit has reached a predetermined concentration value.

BRIEF DESCRIPTION OF THE DRAWINGS

FIG. 5A and FIG. 5B are schematic diagrams showing the movement mechanism provided to the intermediate transfer belt, wherein FIG. 5A shows the posture during color image formation, and FIG. 5B shows the posture during black-and-white image formation.

DETAILED DESCRIPTION OF THE PREFERRED EMBODIMENTS

Figure 1:
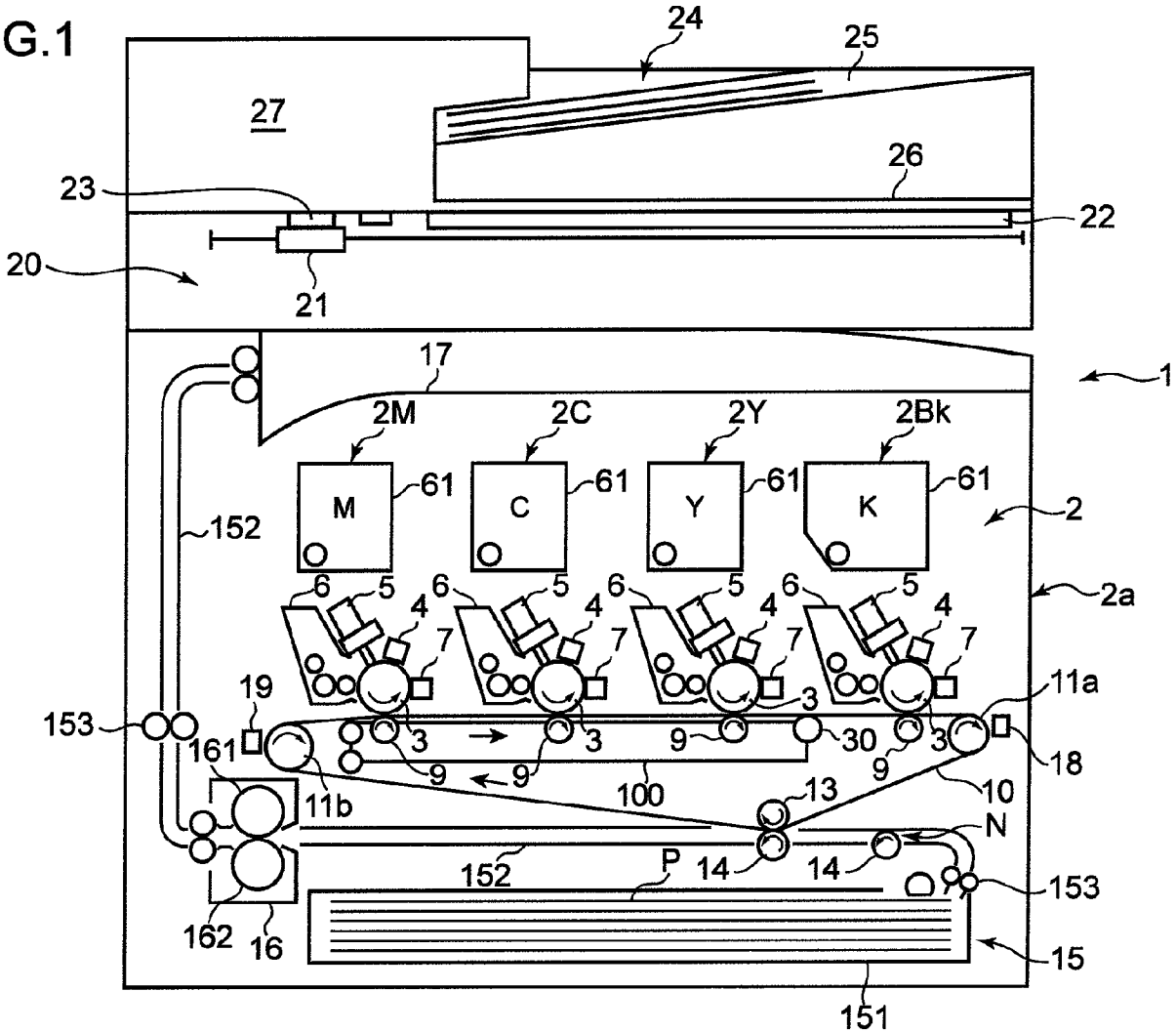
FIG. 1 is a front cross section showing the structure of a multifunction peripheral.

A multifunction peripheral 1 as the first embodiment of the image forming apparatus according to the present invention is now explained with reference to the attached drawings. FIG. 1 is a front cross section showing the structure of the multifunction peripheral 1. As shown in FIG. 1, the multifunction peripheral 1 internally comprises an image forming unit 2. The image forming unit 2 forms (prints) a color image on the recording paper P.

The image forming unit 2 comprises development units 2M, 2C, 2Y, 2Bk arranged internally based on the respective colors of magenta (M), cyan (C), yellow (Y) and black (K), an intermediate transfer belt 10 which is tightly stretched across a plurality of rollers such as a driving roller 11*a* and a secondary transfer opposing roller 13 in a manner enabling endless motion in a sub scanning direction upon image formation, a transfer roller (transfer unit) 9 provided respectively to a position that is opposite to the respective photoreceptor drums 3 of the development units 2M, 2C, 2Y, 2Bk with the intermediate transfer belt 10 positioned therebetween, a secondary transfer roller 14 which comes into contact with the outer circumferential surface of the intermediate transfer belt 10 at a portion where the intermediate transfer belt 10 is tightly stretched across the secondary transfer opposing roller 13 and which transfers the toner image on the intermediate transfer belt 10 to the recording paper P, a concentration sensor 18, and a belt cleaning device 19.

The development units 2M, 2C, 2Y, 2Bk comprise a photoreceptor drum 3 made of amorphous silicon or the like, and a charging device 4, an exposure device 5, a development device 6, and a drum cleaning device 7 disposed around the photoreceptor drum 3, and forms a toner image according to the image data on the circumferential surface of the photoreceptor drum 3 and transfers such toner image to the intermediate transfer belt 10.

The charging device 4 uniformly charges the circumferential surface of the photoreceptor drum 3. The exposure device 5 irradiates a laser beam created based on the image data send from the control part 111 described later onto the circumferential surface of the charged photoreceptor drum 3, and forms an electrostatic latent image on the circumferential surface of the photoreceptor drum 3. The development device 6 affixes the toner supplied from the toner supply part 61 to the electrostatic latent image formed on the photoreceptor drum 3, and actualizes the electrostatic latent image as a toner image. The drum cleaning device 7 cleans the toner remaining on the circumferential surface of the photoreceptor drum 3 after the completion of the primary transfer of the toner image to the intermediate transfer belt 10 described later.

An intermediate transfer belt 10 to which the toner image actualized on the circumferential surface of the photoreceptor drum 3 is intermediately transferred (primarily transferred) is disposed below the development units 2M to 2Bk. In a state of being pressed to the photoreceptor drum 3 by the transfer roller 9 disposed opposite to the respective photoreceptor drums 3, the intermediate transfer belt 10 is tightly stretched across the driving roller 11*a* on the right side of FIG. 1, a driven roller 11*b* on the left side of FIG. 1, and the secondary transfer opposing roller 13 positioned below the driving roller 11*a* and the driven roller 11*b* in a manner enabling endless motion.

The intermediate transfer belt 10 is driven by the driving roller 11*a* and achieves an endless motion among the respective rollers described above. The toner image of the respective colors formed on the photoreceptor drum 3 is transferred and superposed on the intermediate transfer belt 10 moving in endless motion in the order of M, C, Y, K according to the timing of each color. A color image made of the four colors of M, C, Y, K is thereby formed on the intermediate transfer belt 10. Note that, in this embodiment, the formation of a black-and-white toner image of performing image formation only with the development unit 2Bk among the development units 2M, 2Y, 2C, 2Bk is also possible.

A belt cleaning device 19 is provided at the position opposite to the driven roller 11*b* in the outer circumferential direction of the intermediate transfer belt 10. The belt cleaning device 19 removes (recovers) the residual toner on the intermediate transfer belt 10. The belt cleaning device 19 is configured from a cleaning electrode and a cleaning brush (rotating brush) not shown, applies a cleaning bias of a reverse polarity as the electrification charge of the toner to the cleaning brush using the cleaning electrode, moves the toner on the intermediate transfer belt 10 to the cleaning brush with the electrostatic force, and thereby removes the toner. Note that the toner pattern tp described later formed on the intermediate transfer belt 10 is removed by the belt cleaning device 19 after the concentration is detected by the concentration sensor 18.

In this embodiment, provided is a movement mechanism 100 for moving the intermediate transfer belt 10 in a direction of coming in contact with and separating from the development units 2M, 2C, 2Y. Details concerning the movement mechanism 100 shall be explained later with reference to FIG. 5A,5B and FIG. 6, and FIG. 1 only shows the outline of the movement mechanism 100.

The secondary transfer roller 14 applies a predetermined transfer bias to the recording paper P based on a command from the control part 111 (refer to FIG. 4), and causes the color image on the intermediate transfer belt 10 to be secondarily transferred onto the recording paper P.

Moreover, the multifunction peripheral 1 comprises a paper feed unit 15 for feeding paper toward the development units 2Y to 2Bk. The paper feed unit 15 includes a paper feed cassette 151 for housing the recording paper P, a sheet transport path 152 as a path on which the recording paper P is transported, and a transport roller 153 for transporting the recording paper P on the sheet transport path 152, and transports the recording paper P that is extracted one by one from the paper feed cassette 151 toward the position of the secondary transfer roller 14. Note that the paper feed unit 15 transports the recording paper P that was subject to the secondary transfer processing to the fixation device 16, and discharges the recording paper P that was subject to the fixation processing to the paper catch tray 17 provided at the upper part of the multifunction peripheral 1.

The fixing device 16 is provided more downstream than the secondary transfer roller 14 in the sheet transport path 152, and fixes the toner image transferred to the recording paper P. The fixing device 16 is configured from a heating roller 161 and a pressure roller 162, melts the toner on the recording paper P with the heat from the heating roller 161, applies pressure with the pressure roller 162 and fixes the toner on the recording paper P.

A concentration sensor (toner pattern concentration detection unit) 18 is provided downstream in the traveling direction of the intermediate transfer belt 10 relative to the respective nip parts of the development units 2M, 2C, 2Y, 2Bk and the intermediate transfer belt 10 on the outer circumferential surface of the intermediate transfer belt 10. The concentration sensor 18 is capable of detecting the concentration of the toner pattern being a concentration detection toner image that has been transferred onto the circumferential surface of the intermediate transfer belt 10 from the respective photoreceptor drums 3 of the respective development units 2M, 2C, 2Y, 2Bk. The concentration sensor 18 is used for detecting the concentration of the toner pattern that is formed on the intermediate transfer belt 10 by the development units 2M, 2Y, 2C, 2Bk and the respective transfer rollers 9 during the execution of calibration. In this embodiment, upon performing the pressing state adjustment of the intermediate transfer belt 10 and the development units 2M, 2Y, 2C described later, the concentration sensor 18 is used for detecting the concentration of the toner pattern formed on the intermediate transfer belt 10 by the development unit 2M and its corresponding transfer roller 9. Nevertheless, the concentration sensor for the pressing state adjustment of the intermediate transfer belt 10 and the development units 2M, 2Y, 2C may be provided separately from the concentration sensor 18 for calibration.

A manuscript reading unit 20 and a manuscript feed part 24 are provided at the upper part of the multifunction peripheral 1. The manuscript reading unit 20 comprises a scanner unit 21 configured from a CCD (Charge Coupled Device) sensor including a plurality of pixels and an exposure lamp, a manuscript table 22 configured from a transparent member such as glass, and a manuscript reading slit 23. The scanner unit 21 is configured movably by a driving unit not shown, and, upon reading the manuscript mounted on the manuscript table 22, moves along the manuscript surface at a position opposite to the manuscript table 22, scans the manuscript image and simultaneously outputs the acquired image data (respective pixel data) to the control part 111 (refer to FIG. 4). Moreover, upon reading the manuscript fed from the manuscript feed part 24, the scanner unit 21 moves to the position opposite to the manuscript reading slit 23 and acquires the manuscript image in synch with the transport operation of the manuscript based on the manuscript feed part 24 via the manuscript reading slit 23, and outputs such image data to the control part 111.

The manuscript feed part 24 comprises a manuscript mounting part 25 for mounting the manuscript, a manuscript discharge part 26 for discharging the read manuscript, and a manuscript transport mechanism 27 configured from a paper feed roller or a transport roller (not shown) for feeding the manuscript mounted on the manuscript mounting part 25 one by one and transporting it to the position opposite to the manuscript reading slit 23, and discharging it to the manuscript discharge part 26. The manuscript transport mechanism 27 further comprises a sheet reversal mechanism (not shown) for reversing the front and rear of the manuscript and transporting it once again to the position opposite to the manuscript reading slit 23, and is able to read the two-sided image of the manuscript from the scanner unit 21 via the manuscript reading slit 23.

Moreover, the manuscript feed part 24 is provided in a freely rotatable manner to the multifunction peripheral 1 so that its front surface side can move upward. As a result of moving the front surface side of the manuscript feed part 24 upward and opening the upper surface of the manuscript table 22, the manuscript to be read; for instance, an open book or the like can be mounted by the user on the upper surface of the manuscript table 22.

Figure 2:
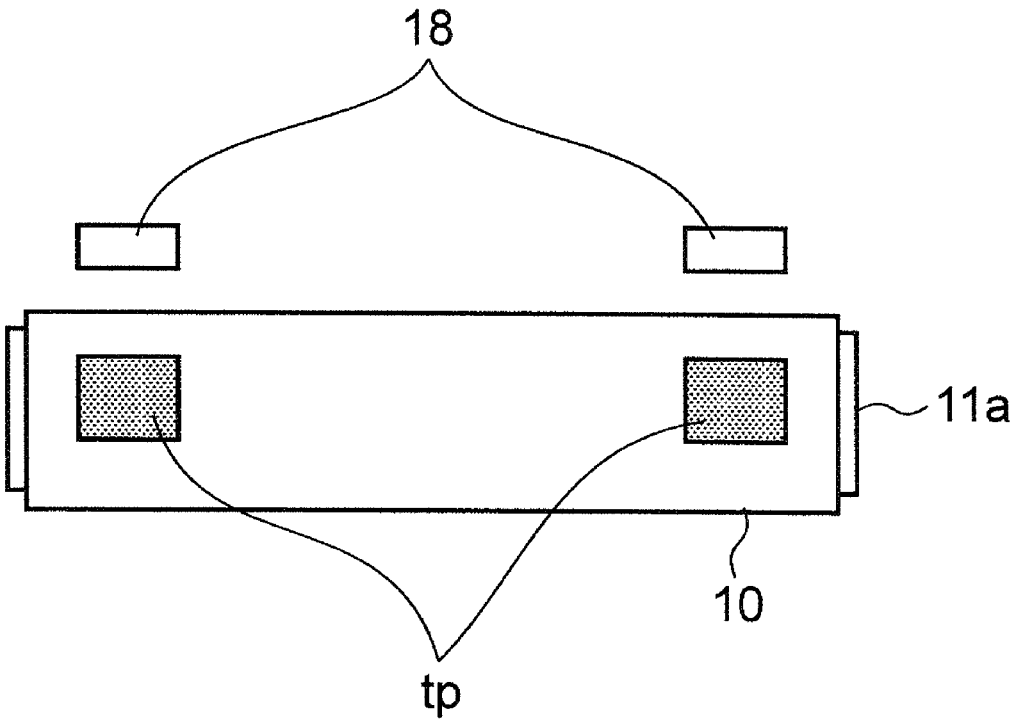
FIG. 2 is a schematic diagram showing the intermediate transfer belt formed with a toner pattern for detecting the contact state of the development unit and the intermediate transfer belt, and the concentration sensors.
Figure 3:
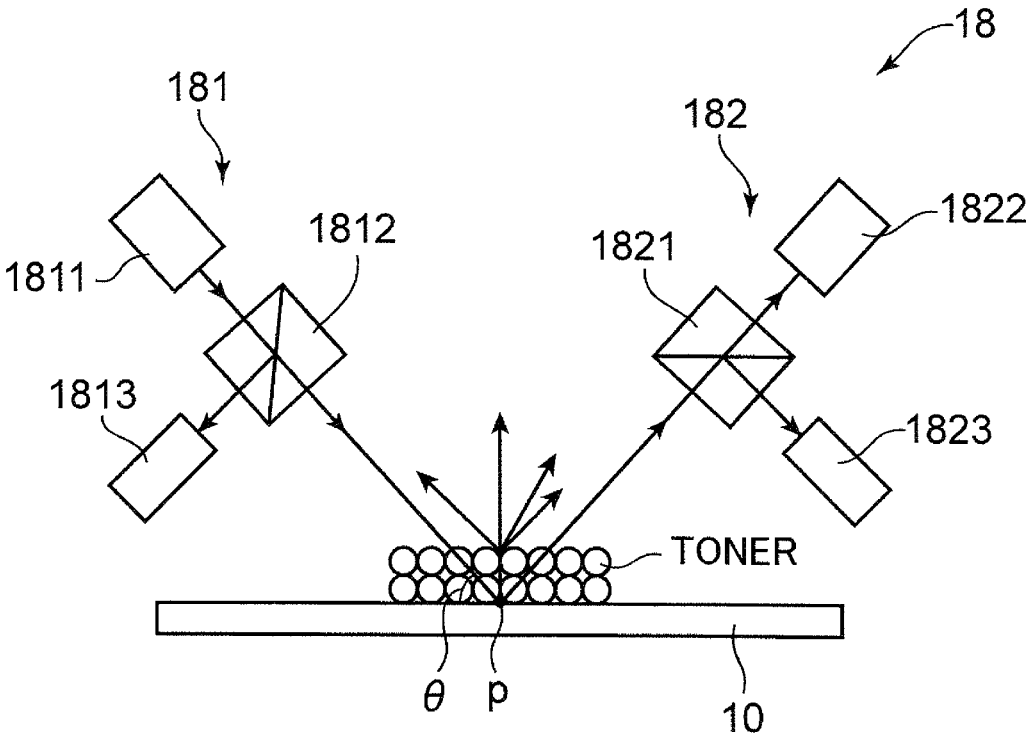
FIG. 3 is a diagram showing the configuration of the concentration sensor.

The foregoing concentration sensor 18 is now explained. FIG. 2 is a schematic diagram showing the intermediate transfer belt 10 formed with a toner pattern for detecting the contact state of the development units 2M, 2C, 2Y, 2Bk and the intermediate transfer belt 10, and the concentration sensor 18. FIG. 3 is a diagram showing the configuration of the concentration sensor 18.

The concentration sensor 18 is provided, for example, at two different positions (this does not mean that the number of concentration sensors 18 is limited to two) in the longitudinal direction (rotating axis direction) of the driving roller 11*a* of the intermediate transfer belt 10. As shown in FIG. 2, the respective concentration sensors 18 are disposed at a predetermined interval at a distance from the circumferential surface of the intermediate transfer belt 10 so as to face the vicinity of both ends in the width direction (longitudinal direction of the driving roller 11*a*) of the intermediate transfer belt 10. The concentration sensor 18 is electrically connected to the control part 111, and outputs the detected concentration of the toner pattern to the control part 111.

The concentration sensor 18 is configured, for example, as follows. As shown in FIG. 3, with the concentration sensor 18, a light-emitting part 181 is disposed on one side in the traveling direction of the intermediate transfer belt 10 relative to an arbitrary point p on the circumferential surface of the intermediate transfer belt 10, and a light-receiving part 182 is disposed on the other side. The light-emitting part 181 comprises a light source part 1811 for outputting light toward the foregoing point p on the circumferential surface of the intermediate transfer belt 10, a beam splitter 1812 for splitting the light that was output from the light source part 1811 into first and second polarization components, and a light-receiving element 1813 for receiving one polarization component from the beam splitter 1812. The first and second polarization components are a P wave capable of obtaining a large output relative to the black toner image, and an S wave capable of obtaining a large output relative to the color toner images of the magenta toner, cyan toner and yellow toner. Subsequently, the P was directly enters the circumferential surface of the intermediate transfer belt 10, and the S wave enters the light-receiving element 1813 after being extracted by the beam splitter 1812.

The light-emitting part 181 is configured, for example, by comprising an LED (Light Emitting Diode), and outputs light containing the same amount of the P wave and S wave toward the point p in a manner of forming an angle θ relative to the circumferential surface of the intermediate transfer belt 10. The light-receiving element 1813 is mounted for controlling the output operation of the light-emitting part 181, and a signal that is proportional to the amount of irradiated light from the light-receiving element 1813 is output to the control part 111. The control part 111 controls the output light of the light source part 1811 so that the output signal of the light-receiving element 1813 is always constant.

The light-receiving part 182 is configured by comprising a beam splitter 1821 for splitting the light that was reflected off the circumferential surface of the intermediate transfer belt 10 into the first and second polarization components, a first light-receiving element 1822 for receiving light of the first polarization component of the first and second polarization components that were split by the beam splitter 1821, and a second light-receiving element 1823 for receiving light of the second polarization component of the first and second polarization components.

The light from the light-emitting part 181 that was reflected off the circumferential surface of the intermediate transfer belt 10 contains specular reflected light in the vicinity of the same angle as the foregoing incident angle θ and other diffused light, and, as a result of the ratio of the diffused light components increasing according to the amount of toner that was transferred onto the circumferential surface of the intermediate transfer belt 10, the ratio of the first and second polarization components received by the first and second light-receiving elements 1822, 1823 will change.

The concentration sensor 18 uses this principle and outputs, to the control part 111, an analog voltage corresponding to the ratio of the first and second polarization components received by the first and second light-receiving elements 1822, 1823. When there is no toner on the circumferential surface of the intermediate transfer belt 10, the first polarization component to be received by the first light-receiving element 1822 becomes maximum and the output voltage becomes a maximum value. As the amount of toner on the circumferential surface of the intermediate transfer belt 10 increases, the amount of light of the first polarization component decreases and the output voltage decreases. The concentration sensor 18 outputs the output voltage to the control part 111, for example, upon inverting it with an inverting circuit or the like. The control part 111 calculates the amount of toner that is adhered to the circumferential surface of the intermediate transfer belt 10 based on the output signal of the concentration sensor 18.

Figure 4:
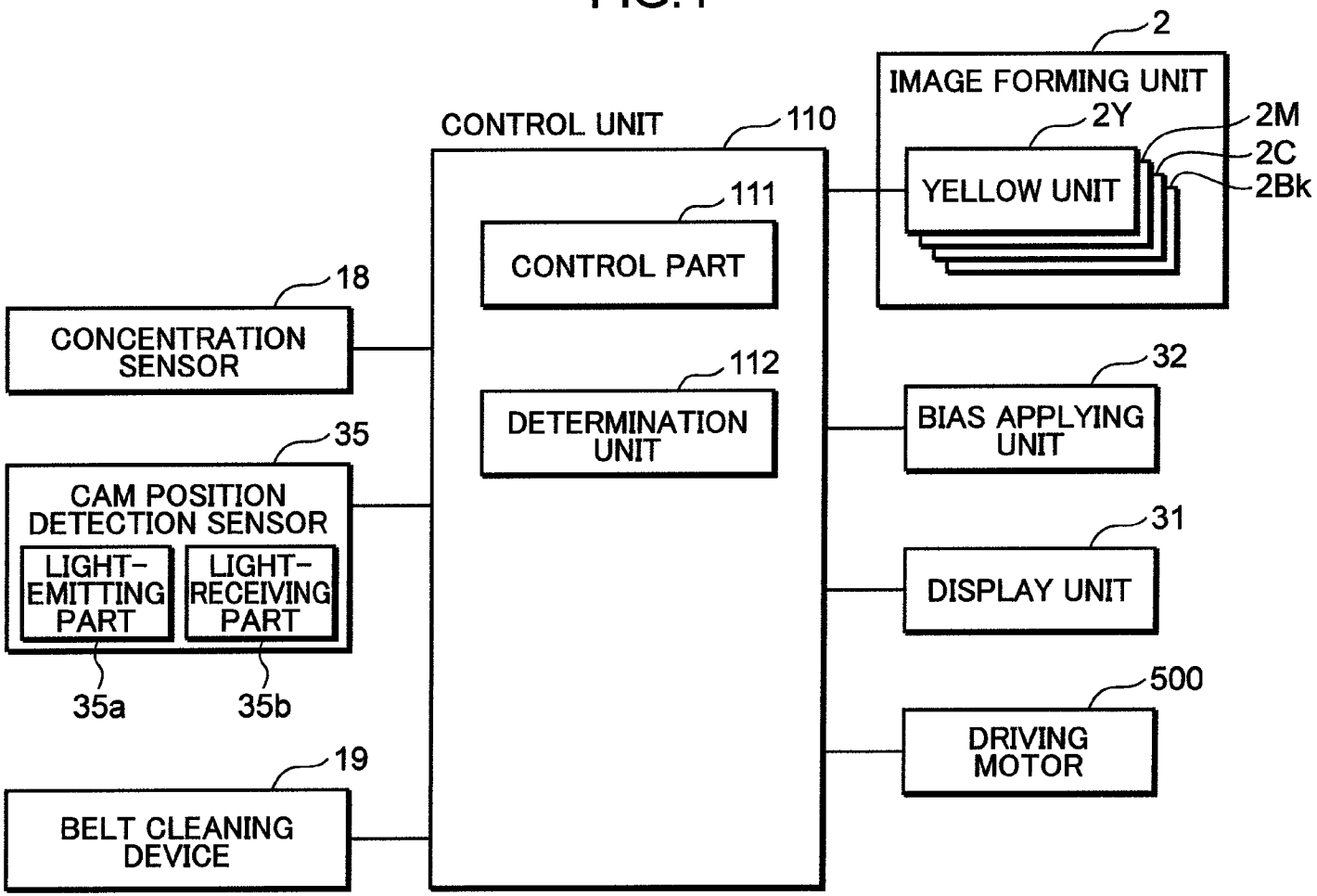
FIG. 4 is a block diagram showing the schematic configuration of the control system of a multifunction peripheral.

The configuration of the control system of the multifunction peripheral 1 is now explained. FIG. 4 is a block diagram showing the schematic configuration of the control system of the multifunction peripheral 1.

The control unit 110 is configured from a CPU, a ROM, a RAM and the like. The control unit 110 includes a control part 111 for inputting/outputting various signals and performing computation, and a determination unit 112.

The control part 111 controls an image forming unit 2 including the development units 2M, 2Y, 2C, 2Bk of the respective colors, a bias applying part 32 including a first bias applying part for applying a transfer bias to the transfer roller 9 and a second bias applying part for applying a transfer bias to the secondary transfer roller 14, and a display unit 31 configured from an LCD (Liquid Crystal Display) or the like. The foregoing concentration sensor 18 is connected to the control part 111 so as to enable the output of detection signals. The control part 111 governs the overall operational control of the multifunction peripheral 1 and controls of the mechanism of the respective components of the apparatus, but FIG. 4 only shows the mechanism concerning the adjustment processing of the contact state (pressing state) of the development units 2M, 2Y, 2C, 2Bk and the intermediate transfer belt 10.

Moreover, a driving motor (collective designation of the respective driving sources) 500 as the respective driving sources of the secondary transfer roller 14, the intermediate transfer belt 10, the image forming unit 2, the fixation device 16 and the movement mechanism 100 described later is also controlled by the control part 111.

During the pressing state adjustment of the development units 2M, 2Y, 2C, 2Bk and the intermediate transfer belt 10, the control part 111 drives the image forming unit 2, the driving motor 500 and the like and causes the magenta development unit 2M of the image forming unit 2 to form a toner pattern tp, for example, respectively in the vicinity of both ends in the width direction on the intermediate transfer belt 10 (FIG. 2). This toner pattern tp is configured from a predetermined concentration (for instance, ID value 1.4 (sensor value 633)), and, for example, is a square shape with one side being approximately 2 cm. However, this embodiment does not intend to limit the toner pattern tp to the foregoing concentration and shape. In this embodiment, when the control part 111 forms the toner pattern tp, the concentration of the toner pattern tp is detected, for example, by the concentration sensor 18 that is disposed further downstream than the nip part of the development units 2M, 2Y, 2C, 2Bk and the intermediate transfer belt 10 (specifically, the nip part of the development unit 2Bk that is most downstream in the traveling direction of the intermediate transfer belt 10, and the intermediate transfer belt 10).

The determination unit 112 determines whether the concentration of the toner pattern tp that was detected by the concentration sensor 18 has reached a predetermined concentration value (described later), and, when the concentration of the toner pattern tp has reached such predetermined value, determines that the state where the intermediate transfer belt 10 is being pressed by the development units 2M, 2Y, 2C, 2Bk is normal.

If the determination unit 112 determines that the state where the intermediate transfer belt 10 is being pressed by the development units 2M, 2Y, 2C, 2Bk is not normal, the control part 111 causes the display unit 31 to issue a warning to the user.

Specifically, in the case of image formation based on the secondary transfer method using the intermediate transfer belt 10, if the contact of the photoreceptor drum 3 of the development unit 2M and the intermediate transfer belt 10 is insufficient or excessive and a nip part of an appropriate pressing state is not formed between the photoreceptor drum 3 of the development unit 2M and the intermediate transfer belt 10 when the toner pattern is transferred from the development unit 2M to the intermediate transfer belt 10, the transfer of the toner image from the photoreceptor drum 3 to the intermediate transfer belt 10 becomes insufficient, and, therefore, the concentration of the toner pattern tp that is transferred onto the circumferential surface of the intermediate transfer belt 10 by the development unit 2M becomes low. Based on the above, in this embodiment, after the foregoing toner pattern tp is transferred to the intermediate transfer belt 10, if the concentration of the toner pattern that is detected by the concentration sensor 18 has reached the predetermined concentration value, then the determination unit 112 determines that the pressing state of the development units 2M, 2Y, 2C, 2Bk and the intermediate transfer belt 10 is normal.

The movement mechanism of moving the intermediate transfer belt 10 in a direction of coming in contact with and separating from the development units 2M, 2Y, 2C, 2Bk is now explained. FIG. 5 is a schematic diagram showing the movement mechanism provided to the intermediate transfer belt 10, wherein FIG. 5A shows the posture during color image formation, and FIG. 5B shows the posture during black-and-white image formation;

In the traveling direction of the intermediate transfer belt 10, a first backup roller 30 is provided between the photoreceptor drum 3 of the development unit 2Bk and the photoreceptor drum 3 of the development unit 2Y.

The movement mechanism 100 is a mechanism of moving the intermediate transfer belt 10 in a direction of coming in contact with and separating from the respective photoreceptor drums 3 of the development units 2M, 2C, 2Y. The movement mechanism 100 comprises a support member 101, an eccentric cam 102, a driving motor 103, and a biasing member 104. The movement mechanism 100 is provided at a position that is opposite to the respective photoreceptor drums 3 of the development units 2M, 2C, 2Y with the intermediate transfer belt 10 positioned therebetween.

Figure 5A:
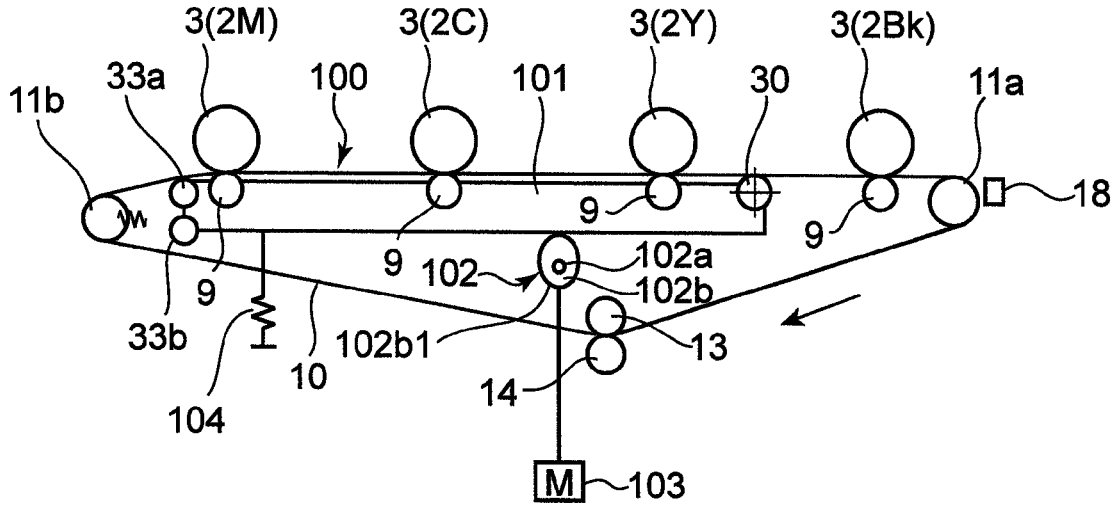
Figure 5B:
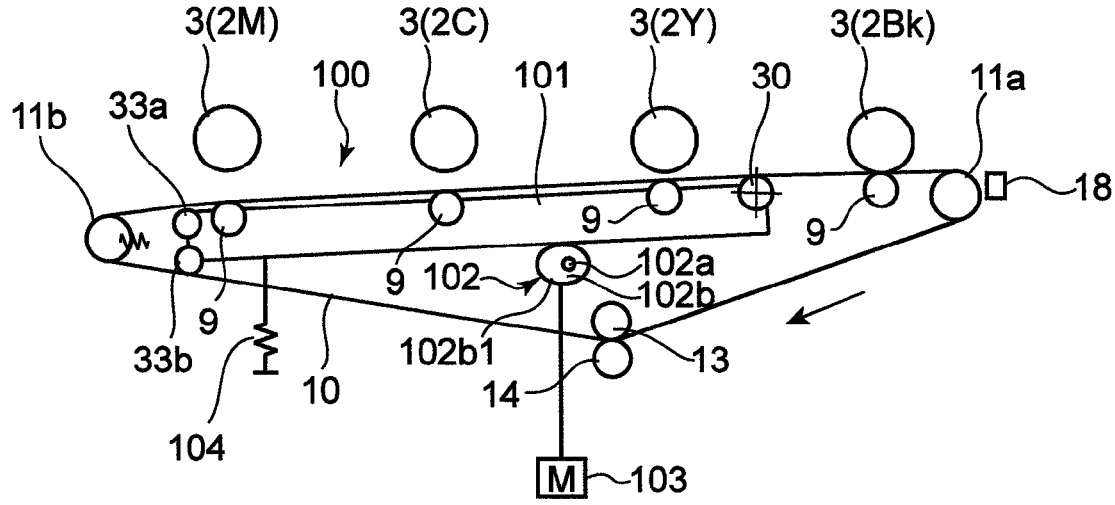

As shown in FIG. 5A and FIG. 5B, the support member 101 extends across the respective transfer rollers 9 corresponding to the development units 2M, 2C, 2Y in the traveling direction of the intermediate transfer belt 10, and is provided in an extending manner up to the length of both ends of the rotating axis in the rotating axis direction of the respective transfer rollers 9. The respective transfer rollers 9 corresponding to the development units 2M, 2C, 2Y are axially supported by the support member 101 in a rotatable manner. The support member 101 is configured so that the development units 2M, 2C, 2Y can rotate between the position of coming in contact with the intermediate transfer belt 10 shown in FIG. 5A and the position of being separated from the intermediate transfer belt 10 shown in FIG. 5B with the rotating axis of the backup roller 30 as the pivot. In addition, the support member 101 is biased by the biasing member 104 in a direction of separating from the intermediate transfer belt 10.

Furthermore, second backup rollers 33*a*, 33*b* are provided to the opposite side (driven roller 11*b* side) of the first backup roller 30 in the traveling direction of the intermediate transfer belt 10 at the support member 101. The second backup roller 33*a* is disposed between the development unit 2M and the driven roller 11*b* in the traveling direction of the intermediate transfer belt 10. The second backup roller 33*a* and the second backup roller 33*b* are axially supported by the support member 101 in a rotatable manner, and rotate together with the support member 101.

The eccentric cam 102 includes a cam drive axis 102*a* that extends longer than the width of the support member 101 in the rotating axis direction of the transfer roller 9, and the cam drive axis 102*a* is axially supported by a side wall or the like of the apparatus body 2*a*. A cam part 102*b* of the eccentric cam 102 is provided to a plurality of locations in the length direction of the cam drive axis 102*a*, and its circumferential surface part 102*b*1 slidably rotates while coming in contact with a part of the support member 101. The driving motor 103 is a driving source for applying the rotational driving force to the eccentric cam 102. As a result of the eccentric cam 102 rotating based on the driving force applied from the driving motor 103, the circumferential surface part 102*b*1 of the cam part 102*b* presses the support member 101 in the direction of the development units 2M, 2Y, 2C, 2Bk. The support member 101 thereby rotates from the position shown in FIG. 5B to the position shown in FIG. 5A together with the respective transfer rollers 9 and the second backup roller 33*a* which are axially supported at the support member 101.

Note that the respective transfer rollers 9 and the second backup roller 33*a* which are axially supported by the support member 101 are being biased from above the support member 101 by a biasing member such as spring not shown so as to be pressed toward the respective photoreceptor drums 3 of the development units 2M, 2C, 2Y with the intermediate transfer belt 10 positioned therebetween. Meanwhile, the transfer roller 9 corresponding to the photoreceptor drum 3 of the development unit 2Bk is being biased by a biasing member (not shown) such as a spring so as to come in contact with the photoreceptor drums 3 with the intermediate transfer belt 10 positioned therebetween.

Moreover, a cam position detection sensor (pressing state detection unit) 35 for detecting the posture of the camp part 102*b* which rotates based on the cam drive axis 102*a* is mounted at the bottom face of the support member 101 or the apparatus body 2*a* that becomes the vicinity of the position where the cam part 102*b* is disposed in the cam drive axis 102*a*. Note that the cam position detection sensor 35 is shown in FIG. 4. The cam position detection sensor 35 comprises a light-emitting part 35*a* and a light-receiving part 35*b*. The light-emitting part 35*a* is provided to one side of the cam part 102*b* with the cam part 102*b* positioned therebetween, and the light-receiving part 35*b* is provided to the other side of the cam part 102*b*. The light-emitting part 35*a* and the light-receiving part 35*b* are disposed, for example, at the bottom face of the support member 101 or above the apparatus body 2*a* such that when the cam part 102*b* is rotated by the cam drive axis 102*a* and becomes eccentric, and as a result assumes a posture within a fixed range before and after the posture shown in FIG. 5A (from the intermediate transfer belt 10 reaching a state of being pressed by the respective photoreceptor drums 3 of the development units 2M, 2Y, 2C due to the change in the eccentricity associated with the rotation of the cam part 102*b* until such pressing state is released due to the change in the eccentricity associated with the further rotation of the cam part 102*b*), the light that is emitted by the light-emitting part 35*a* is blocked by the cam part 102*b* and is not received by the light-receiving part 35*b*, and such that when the cam part 102*b* assumes a posture other than the posture shown in FIG. 5A, the light that is emitted by the light-emitting part 35*a* is not blocked by the cam part 102*b* and is received by the light-receiving part 35*b*.

The cam position detection sensor 35 sends a cam detection signal to the control part 111 when the light-receiving part 35*b* is not receiving the light from the light-emitting part 35*a*. Specifically, the cam detection signal is sent when the cam part 102*b* is rotated by the cam drive axis 102*a* and becomes eccentric and enters a state that is similar to the posture shown in FIG. 5A, the support member 101 approaches the side of the development units 2M, 2Y, 2C, and the intermediate transfer belt 10 becomes pressed against the respective photoreceptor drums 3 of the development units 2M, 2Y, 2C by the respective transfer rollers 9 above the support member 101. Thus, the cam detection signal is a pressing state detection signal showing that the intermediate transfer belt 10 is in a state of being pressed by the respective photoreceptor drums 3 (pressing state of the intermediate transfer belt 10 and the respective photoreceptor drums 3 of the development units 2M, 2Y, 2C, 2Bk is in a state of the color image forming operation).

The operation of the movement mechanism 100 is controlled by the drive control of the driving motor 103 based on the control part 111 so that it moves to the position shown in FIG. 5A during color image formation and moves to the position shown in FIG. 5B during black-and-white image formation.

During color image formation, based on the rotation of the eccentric cam 102, for example, the support member 101 moves to the position shown in FIG. 5A, and the second backup roller 33*a* applies tension to the intermediate transfer belt 10 in a state where the circumferential surface of the intermediate transfer belt 10 and the respective transfer rollers 9 of the development units 2M, 2Y, 2C, 2Bk are in contact. Thus, the contact portion of the intermediate transfer belt 10 and the photoreceptor drum 3 of the development unit 2Bk and the contact portion of the intermediate transfer belt 10 and the respective photoreceptor drums 3 of the development units 2M, 2C, 2Y are not easily affected by changes in the intermediate transfer belt 10 such as the defection or vibration thereof. Note that, since the support member 101 swings with the first backup roller 30 as the pivot, there is no change in the contact state of the photoreceptor drum 3 of the development unit 2Bk relative to the intermediate transfer belt 10 during the color image forming operation and during the black-and-white image forming operation.

Meanwhile, during the black-and-white image forming operation, as shown in FIG. 5B, the support member 101 rotates in a direction of separating from the respective photoreceptor drums 3 of the development units 2M, 2C, 2Y, and the intermediate transfer belt 10 which was released from being pressed toward the respective photoreceptor drums 3 of the development units 2M, 2C, 2Y by the respective transfer rollers 9 that are axially supported by the support member 101 becomes separated from the respective photoreceptor drums 3 of the development units 2M, 2C, 2Y. Pursuant to the rotation of the support member 101, if no tension is applied to the intermediate transfer belt 10, the second backup roller 33*a* moves to a direction of releasing the bias, and the tension of the intermediate transfer belt 10 will thereby decrease.

Nevertheless, pursuant to the change in posture of the support member 101 in the foregoing case, the second backup roller 33*b* is pressed against the inner surface of the intermediate transfer belt 10 between the driven roller 11*b* and the secondary transfer opposing roller 13, which are on the opposite side of the respective photoreceptor drums 3 of the development units 2M, 2C, 2Y, with the support member 101 positioned therebetween, and the second backup roller 33*b* applies a given tension to the intermediate transfer belt 10. Consequently, the foregoing decrease in tension of the intermediate transfer belt 10 is prevented, and the tension of the intermediate transfer belt 10 can be made approximately constant upon coming in contact with and being separated from the respective photoreceptor drums 3 of the development units 2M, 2C, 2Y.

Accordingly, even when switching from the posture during the color image forming operation to the posture during the black-and-white image forming operation, the contact state of the intermediate transfer belt 10 and the photoreceptor drum 3 of the development unit 2Bk can be made approximately constant, and changes in the transfer state of a black image can be inhibited. During the black-and-white image forming operation, the intermediate transfer belt 10 is tightly stretched by the driving roller 11*a*, the driven roller 11*b*, the second backup roller 33*b*, the secondary transfer opposing roller 13 and the first backup roller 30, contacts only the photoreceptor drum 3 of the development unit 2Bk by being driven by the driving roller 11*a*, and travels in the arrow direction shown in FIG. 5A and FIG. 5B while receiving the primary transfer by the transfer roller 9.

Note that, in the switching from the position for the color image forming operation to the position for the black-and-white image forming operation, as a result of the second backup roller 33*b* being pressed against the inner surface, the tension that is applied to the intermediate transfer belt 10 will suffice so as long as it can cover for the decrease in the tension that is applied by the second backup roller 33*a* in the position for the color image forming operation. For example, the relation and the like of the amount of rotation of the support member 101 in the separating direction and the decrease/increase of tension of the intermediate transfer belt 10 can be decided and set based on preliminary experiments and the like.

Figure 6:
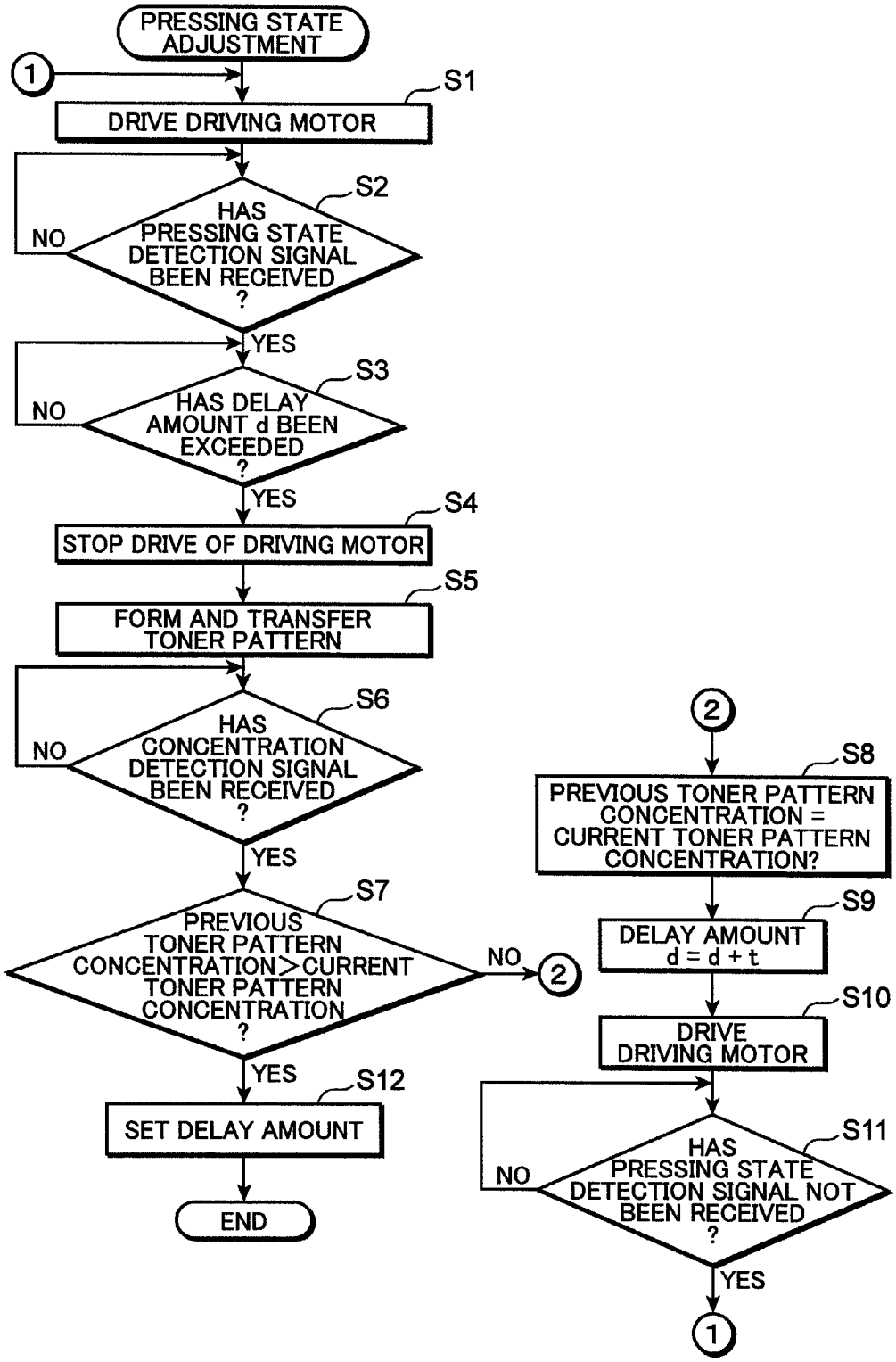
FIG. 6 is a flowchart showing the adjustment processing of a state where the intermediate transfer belt is pressed by the respective photoreceptor drums.
Figure 7:
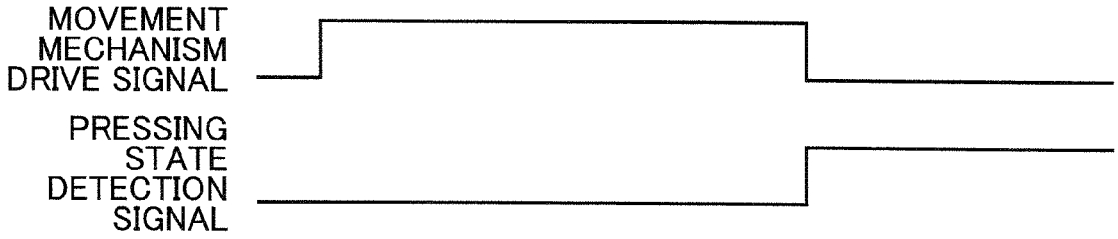
FIG. 7 is a timing chart of a drive signal of the driving motor of the movement mechanism and a detection signal from the cam position detection sensor.
Figure 8:
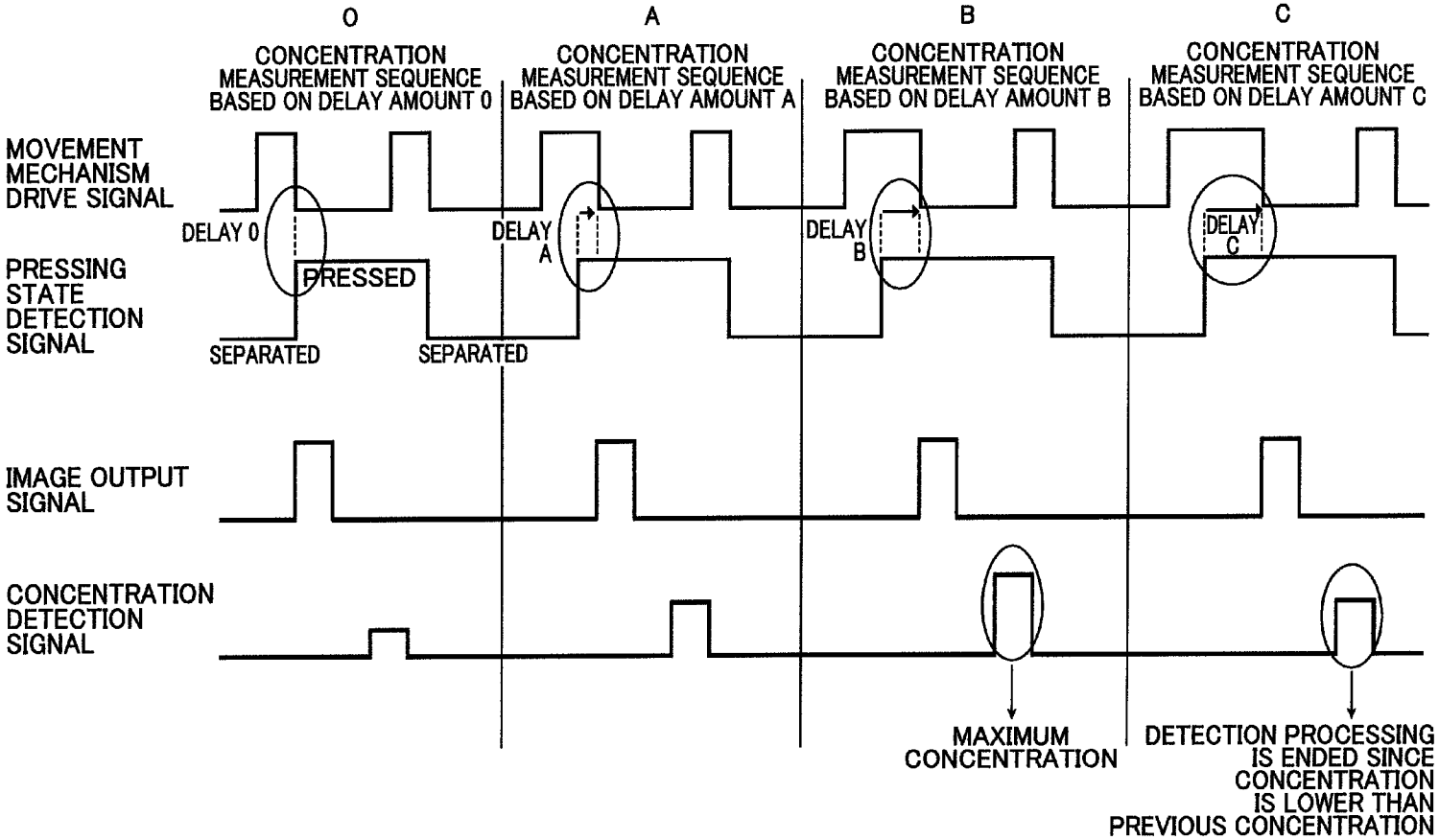
FIG. 8 is a timing chart of a drive signal of the driving motor of the movement mechanism during the adjustment processing of the pressing state of the intermediate transfer belt and the respective photoreceptor drums, a detection signal from the cam position detection sensor, an image output signal that is output to the development unit, and a timing chart of the concentration detection signal from the concentration sensor.
Figure 9:
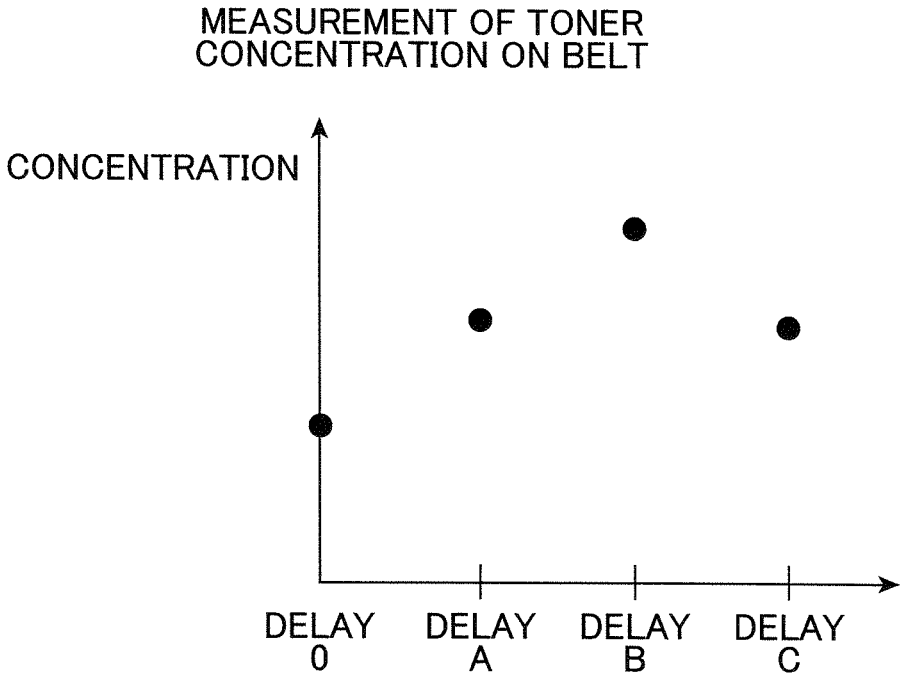
FIG. 9 is a diagram showing a graph of the respective concentrations of the toner pattern that was transferred onto the circumferential surface of the intermediate transfer belt.

The adjustment processing of the state of the intermediate transfer belt 10 being pressed by the respective photoreceptor drums 3 to be performed by the multifunction peripheral 1 is now explained. FIG. 6 is a flowchart showing the adjustment processing of a state where the intermediate transfer belt 10 is being pressed by the respective photoreceptor drums 3. FIG. 7 is a timing chart of the drive signal of the driving motor 103 of the movement mechanism 100 and the detection signal from the cam position detection sensor 35. FIG. 8 is a timing chart of the drive signal of the driving motor 103 of the movement mechanism 100 during the adjustment processing of the pressing state of the intermediate transfer belt 10 and the respective photoreceptor drums 3, the detection signal from the cam position detection sensor 35, the image output signal that is output to the development unit 2M, and the concentration detection signal from the concentration sensor 18. FIG. 9 is a diagram showing, based on a graph, of the respective concentrations of the toner pattern that was transferred onto the circumferential surface of the intermediate transfer belt 10.

As described above, with the multifunction peripheral 1, based on the control by the control part 111, the movement mechanism 100 moves the respective transfer rollers 9 corresponding to the development units 2M, 2C, 2Y to a position of pressing each of the corresponding photoreceptor drums 3 with the intermediate transfer belt 10 positioned therebetween during the color image forming operation, and moves the respective transfer rollers 9 to a position where the intermediate transfer belt 10 is separated from the respective photoreceptor drums 3 during the black-and-white image forming operation.

Subsequently, when the movement mechanism 100 is to rotate the support member 101 for moving the respective transfer rollers 9 and the intermediate transfer belt 10 from the position for the black-and-white image forming operation to the position for the color image forming operation, with the initial setting of the multifunction peripheral 1, as shown in FIG. 7, the control part 111 is set to send a drive signal to the driving motor 103 and rotates the support member 101 with the rotational driving force of the driving motor 103, and, upon receiving the pressing state detection signal that is output from the foregoing cam position detection sensor (example of the pressing/separation detection unit) 35, stop the sending of the drive signal to the driving motor 103. Specifically, at the position upon receiving the pressing state detection signal from the cam position detection sensor 35, the intermediate transfer belt 10 becomes a state of being pressed by the respective photoreceptor drums 3 of the development units 2M, 2Y, 2C.

In the pressing state adjustment processing, the degree of the intermediate transfer belt 10 being pressed by the respective photoreceptor drums 3 during the color image forming operation is adjusted. Upon adjusting the degree of the intermediate transfer belt 10 being pressed by the respective photoreceptor drums 3, foremost, the control part 111 sends a drive signal to the driving motor 103 and drives the driving motor 103 (S1), rotates the support member 101 based on the rotational driving force of the driving motor 103, and moves the support member 101 in the position for the black-and-white image forming operation to the position for the color image forming operation.

Subsequently, the control part 111 determines whether the intermediate transfer belt 10 is being pressed by the respective photoreceptor drums 3 of the development units 2M, 2Y, 2C based on the pressing state detection signal from the cam position detection sensor 35 (S2). When the control part 111 receives the pressing state detection signal from the cam position detection sensor 35 (YES in S2), it determines that the intermediate transfer belt 10 is being pressed by the respective photoreceptor drum 3, and measures whether a predetermined delay amount (delay time from the time of receiving the pressing state detection signal, wherein the delay amount d=0 (msec) during the initial drive of the driving motor 103 (delay amount 0 of FIG. 8), and the subsequent delay amount shall be obtained by adding a predetermined time t (msec) to the delay amount d) has elapsed by using a timer or the like built into the control part 111 (S3). When the control part 111 measures the lapse of the delay amount from the time of receiving the pressing state detection signal (YES in S3), the sending of the drive signal to the driving motor 103 is stopped at this time, and the drive of the driving motor 103 is stopped (S4). Note that, as shown in FIG. 8, the timing of stopping the sending of the drive signal of the driving motor 103 in the first instance will be at the time of receiving the pressing state detection signal.

In addition, as shown in FIG. 8, the control part 111 drives the development unit 2M that is the most upstream in the traveling direction of the intermediate transfer belt 10 so as to form a toner pattern tp at the time of stopping the drive of the driving motor 103, and further transfers the toner pattern tp to the intermediate transfer belt 10 (S5).

Subsequently, when the concentration sensor 18 detects the concentration of the toner pattern tp (S6), the determination unit 112 determines whether the detected toner pattern concentration is less than the previously detected toner pattern concentration based on the concentration detection signal that was received from the concentration sensor 18 (S7). Note that the determination unit 112 uses the concentration value showing the lowest concentration as the previously detected toner pattern concentration during the initial determination.

Here, if the determination unit 112 determines that the detected toner pattern concentration is greater than the previously detected toner pattern concentration (NO in S7), the determination unit 112 stores the currently detected toner pattern concentration as the previously detected toner pattern concentration for use in the subsequent determination in S7 (S8). During the initial determination, the result will be NO in S7, and the routine proceeds to S8.

Then, the control part 111 sets the delay amount d for use in subsequently measuring the delay amount in S3 to delay amount d=d+t (msec) (S9, delay amount A of FIG. 8). The control part 111 thereafter sends a drive signal to the driving motor 103 to drive the driving motor 103 (S10), rotates the support member 101 based on the rotational driving force of the driving motor 103, and moves the intermediate transfer belt 10 from the position of being pressed by the respective photoreceptor drums 3 of the development units 2M, 2Y, 2C to the direction of being separated from the respective photoreceptor drums 3. At the time that the control part 111 no longer receives the pressing state detection signal from the cam position detection sensor 35 and the intermediate transfer belt 10 is separated from the respective photoreceptor drums 3 (YES in S11), the processing returns to S1.

Subsequently, the control part 111 once again starts the processing of S1 onward, and, upon receiving the pressing state detection signal from the cam position detection sensor 35 (YES in S2), determines whether a predetermined delay amount from the foregoing reception by using the delay amount d=d+t (msec) set in S9 (S3, delay amount B of FIG. 8). The processing of S4 to S7 is similarly performed as with the initial processing. In S7, if the determination unit 112 determines that the detected toner pattern concentration is greater than the previously detected toner pattern concentration (NO in S7), the processing of S8 to S11 is repeated once again. In S8, the determination unit 112 sets the currently detected toner pattern concentration as the previously detected toner pattern concentration for use in the subsequent determination in S7 (S8).

The processing of S1 to S11 is repeated as described above (as shown in FIG. 8, in S3, for example, this becomes delay amount 0, A, B, C . . . ), and, in the processing of S7, if the determination unit 112 determines that the detected toner pattern concentration is less than the previously detected toner pattern concentration as shown with the sequence C of FIG. 8 (YES in S7), the control part 111 stores the delay amount d that was used in the processing of S3 that was performed previous to the current S3 (for example, the delay amount B of the sequence B of FIG. 8) in a built-in memory or the like (S12), and configures the setting so that the color image forming operation by the development units 2M, 2C, 2Y, 2Bk is performed in a state where the movement operation by the movement mechanism 100 is stopped at the point in time when the stored delay amount d has elapsed from the time that the cam position detection sensor 35 detects that the intermediate transfer belt 10 is being pressed by the respective photoreceptor drums 3 upon driving the driving motor 103 during the normal color image forming operation.

Specifically, after the toner is transferred to the intermediate transfer belt 10 based on the control of the control part 111, the determination unit 112 determines that the pressing state of the photoreceptor drum 3 of the development units 2M, 2Y, 2C, 2Bk and the intermediate transfer belt 10 moved by the movement mechanism 100 is a normal pressing state at the point in time that the concentration of the toner pattern detected by the concentration sensor 18 has reached a predetermined value (that is, a value showing a concentration that is higher than the state that the driving motor 103 was stopped at a different delay amount).

Note that, in the foregoing explanation, the control part 111 drives the development unit 2M that is most upstream in the traveling direction of the intermediate transfer belt 10 at the time that the drive of the driving motor 103 is stopped to form a toner pattern tp and transfers such toner pattern tp to the intermediate transfer belt 10 with the transfer roller 9 (S5), and the subsequent photoreceptor drum processing is performed based on the toner pattern tp that was transferred onto the circumferential surface of the intermediate transfer belt 10 by the development unit 2M. However, the control part 111 may also be set to use the respective delay amounts d of S3 and drive the development units 2M, 2Y, 2C, 2Bk in S5 to cause them to respectively form a toner pattern tp and transfer such toner pattern tp to the intermediate transfer belt 10, perform each of the subsequent processing based on the respective toner patterns tp that were transferred onto the circumferential surface of the intermediate transfer belt 10 by the development units 2M, 2Y, 2C, 2Bk, and, when the determination unit 112 determines that the currently detected concentration of all toner patterns is less than the previously detected toner pattern concentration in the processing of S7 regarding all toner patterns tp (YES in S7), the control part 111 stores the delay amount d that was used in the processing of S3 previous to the foregoing S3 (S12), and performs the color image forming operation by the development units 2M, 2C, 2Y, 2Bk in a state where the movement operation by the movement mechanism 100 is stopped at the point in time that the stored delay amount d elapses from the time that the cam position detection sensor 35 detects that the intermediate transfer belt 10 is being pressed by the respective photoreceptor drums 3 upon driving the driving motor 103 during the normal color image forming operation.

Figure 10:
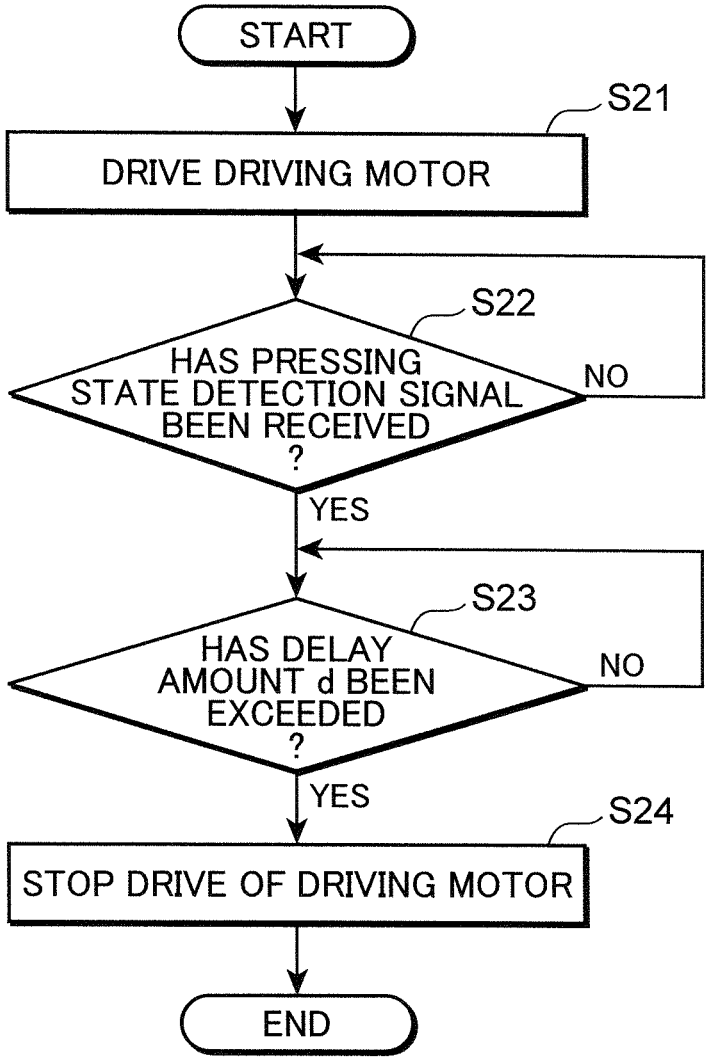
FIG. 10 is a flowchart showing the drive control of the movement mechanism during the normal color image forming operation.
Figure 11:
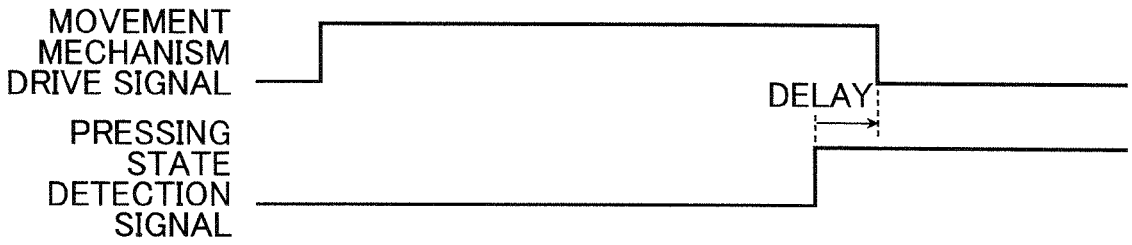
FIG. 11 is a timing chart of a drive signal of the driving motor of the movement mechanism and a detection signal from the cam position detection sensor.

The drive control of the movement mechanism 100 during the normal color image forming operation is now explained. FIG. 10 is a flowchart showing the drive control of the movement mechanism 100 during the normal color image forming operation. FIG. 11 is a timing chart of the drive signal of the driving motor 103 of the movement mechanism 100 and the detection signal from the cam position detection sensor 35.

When the intermediate transfer belt 10 and the respective transfer rollers 9 are to be moved by the movement mechanism 100 from the position for the black-and-white image forming operation to the position for the color image forming operation during the color image forming operation, the control part 111 foremost sends a drive signal to the driving motor 103 and drives the driving motor 103 (S21), rotates the support member 101 based on the rotational driving force of the driving motor 103, and moves the support member 101 from the position for the black-and-white image forming operation to the position for the color image forming operation.

Subsequently, when the control part 111 receives a pressing state detection signal from the cam position detection sensor 35 (YES in S22), the control part 111 determines whether the delay amount d stored by the control part 111 in the processing of S12 shown in FIG. 6 based on measurement using a built-in timer or the like, and, as shown in FIG. 11, at the point of measuring the delay amount d (YES in S23), stops sending the drive signal to the driving motor 103 and stops the drive of the driving motor 103 (S24).

The control part 111 thereafter causes the development units 2M, 2C, 2Y, 2Bk to perform the color image forming operation in a state where the intermediate transfer belt 10 is pressed by the respective photoreceptor drums 3 at the time that the driving motor 103 is stopped based on the color image formation job that was input by an operator using an operating unit not shown.

Figure 12:
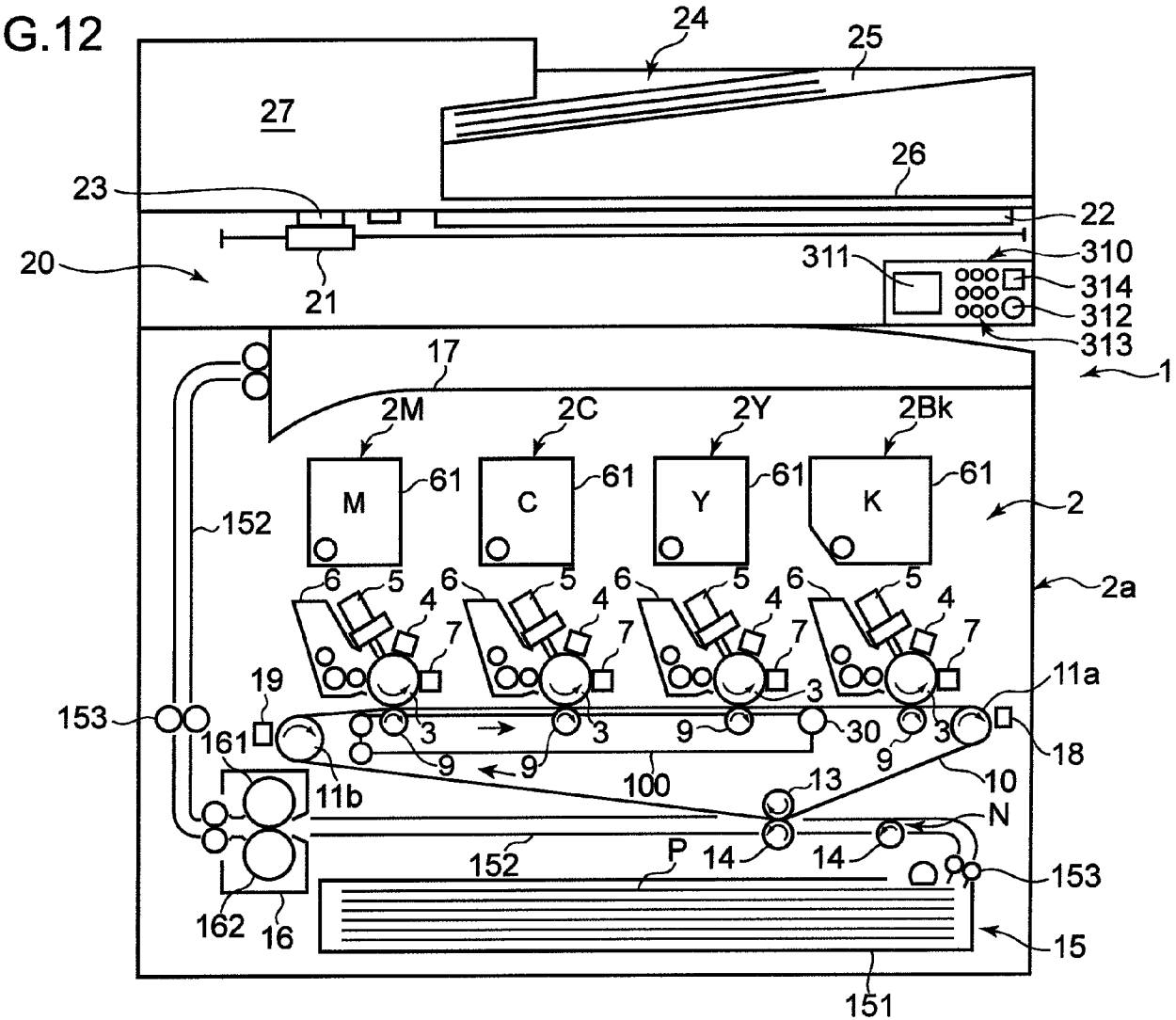
FIG. 12 is a front cross section showing the structure of the multifunction peripheral according to a modified mode of the first embodiment.

The multifunction peripheral 1 as a modified mode of the first embodiment of the image forming apparatus according to the present invention is now explained. Since the schematic configuration of the multifunction peripheral 1 as the modified mode of the first embodiment is basically the same as the multifunction peripheral 1 of the foregoing first embodiment, the explanation of the same configuration is omitted and the differences in the multifunction peripheral 1 according to the modified mode of the first embodiment are mainly explained. FIG. 12 is a front cross section showing the structure of the multifunction peripheral 1 according to the modified mode of the first embodiment.

In this modified mode, as with the first embodiment, provided is a movement mechanism 100 for moving the intermediate transfer belt 10 to a direction of coming in contact with and separating from the development units 2M, 2C, 2Y. Details concerning the movement mechanism 100 are the same as the foregoing first embodiment, and the explanation thereof is omitted. The multifunction peripheral 1 according to the modified mode, as with the multifunction peripheral 1 of the first embodiment, determines whether the pressing state of the development units 2M, 2Y, 2C, 2Bk and the intermediate transfer belt 10 is normal.

In addition, an operating unit 310 is provided to the front portion of the multifunction peripheral 1 according to this modified mode. This operating unit 310 is provided with a start key 312 for the user to input a print execution command, a numerical keypad 313 for inputting the number of copies to be printed, a display unit 311 configured from a liquid crystal display or the like with a touch panel function for displaying operating guide information such as for performing copying operations and used for inputting various settings, and a timing setting command input button 314 for the user to input a command for starting the timing setting of the pressing adjustment described later.

Figure 13:
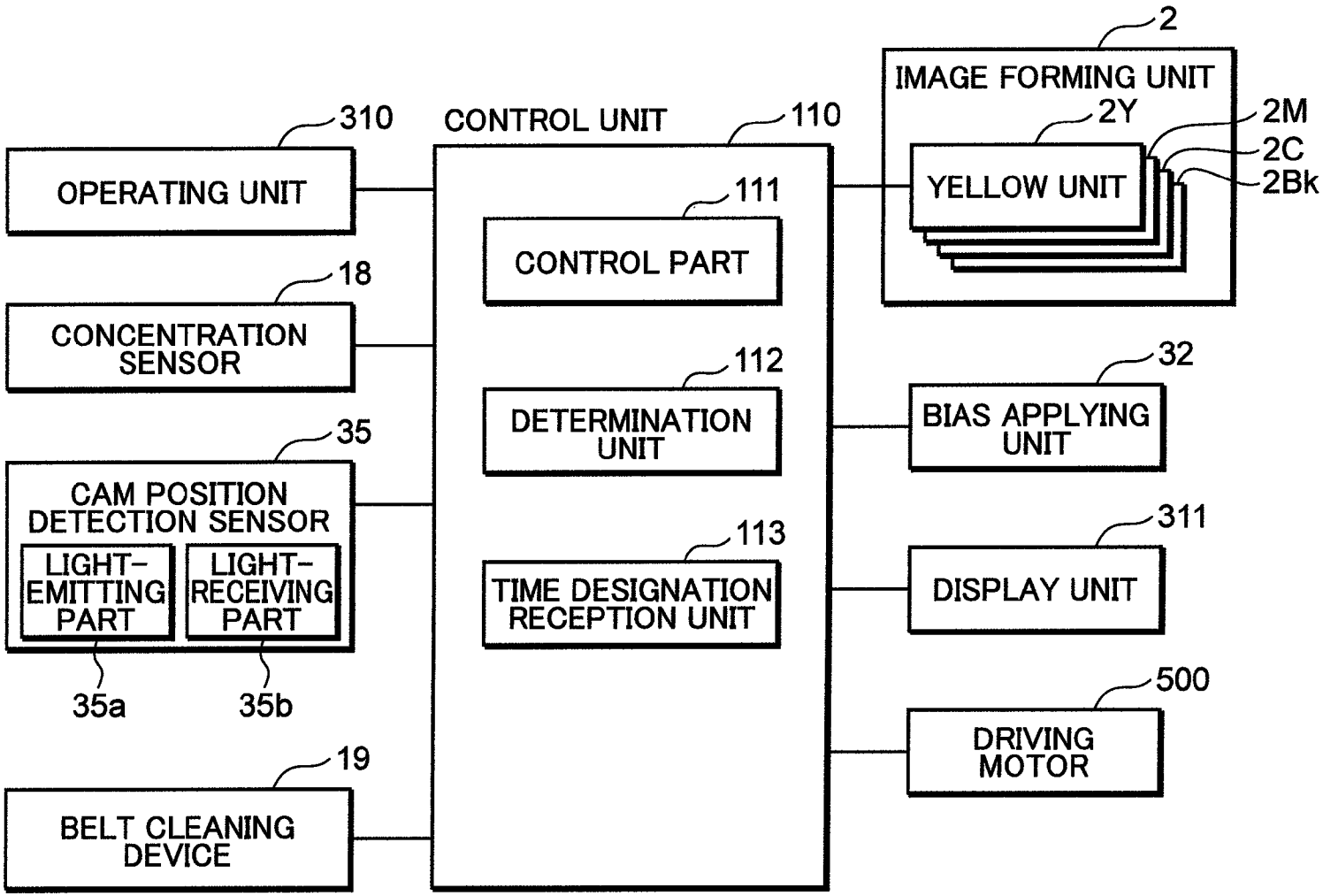
FIG. 13 is a block diagram showing a schematic configuration of the control system of the multifunction peripheral according to a modified mode of the first embodiment.

The configuration of the control system of the multifunction peripheral 1 according to a modified mode of the first embodiment is now explained mainly with respect to the differences in comparison to the multifunction peripheral 1 of the first embodiment. FIG. 13 is a diagram showing a schematic configuration of the control system of the multifunction peripheral 1 according to a modified mode of the first embodiment.

With the multifunction peripheral 1 according to this modified example, the control unit 110 comprises a time designation reception unit 113. The time designation reception unit 113 receives, from the user, a time designation command which designates the time of executing the pressing state adjustment processing based on the user's operation of the operating unit 310. The pressing state adjustment processing includes the pressing state determination (including the toner pattern formation and transfer performed by the development unit 2M and the like and the transfer roller 9 and the foregoing determination by the determination unit 112 based on the control of the control part 111) as a part of its processing. Thus, in this modified mode, when the time designation reception unit 113 receives the time designation command from the user, the pressing state determination is performed as a part of the pressing state adjustment processing. Consequently, in this modified mode, the time designation reception unit 113 also receives, from the user, the time designation command which designates the execution time of the pressing state determination. Note that the operating unit 310 and the time designation reception unit 113 in this modified mode are an example of the time designation reception unit referred to in the claims.

Figure 14:
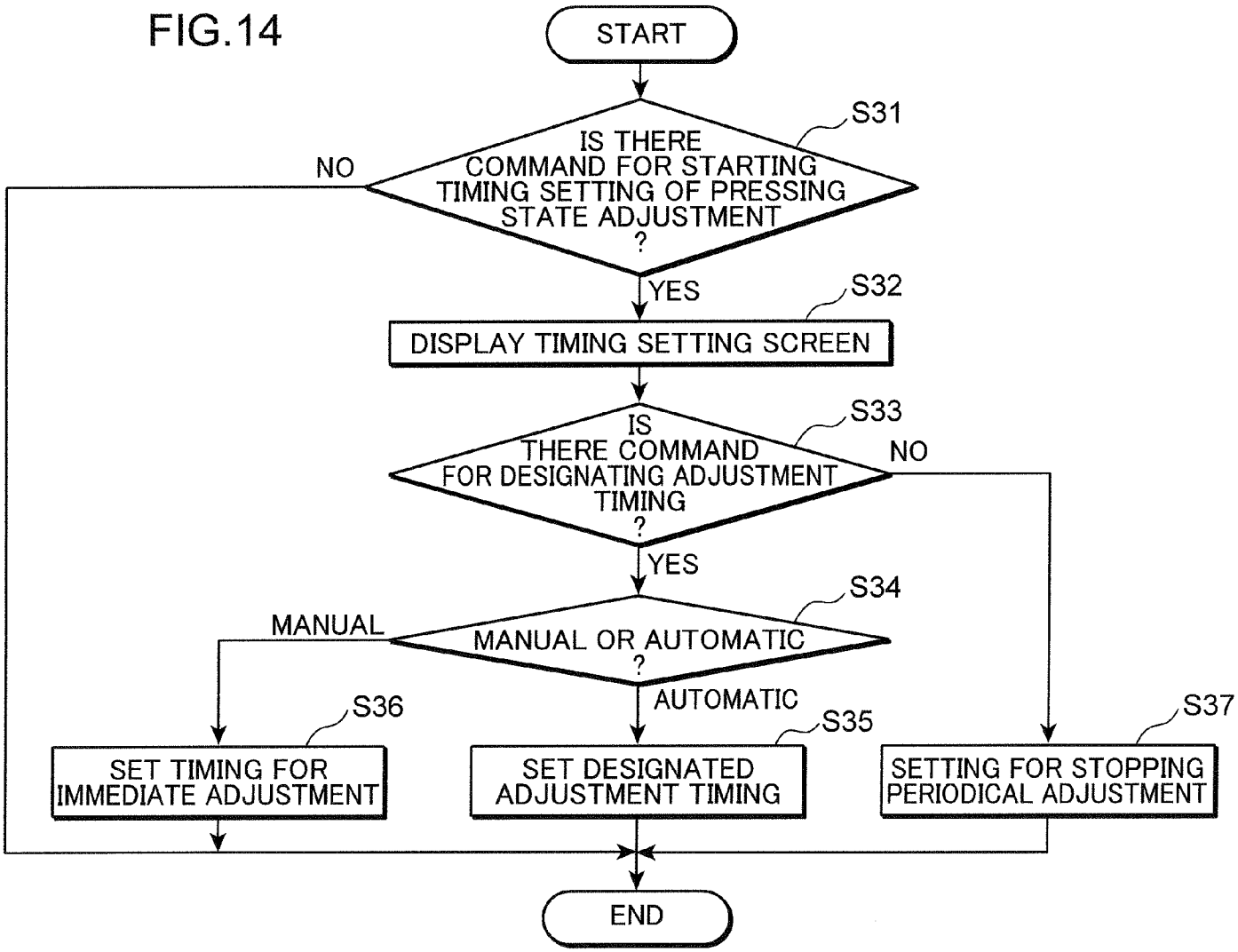
FIG. 14 is a flowchart showing the processing flow upon setting the execution timing of the pressing adjustment processing.
Figure 15:
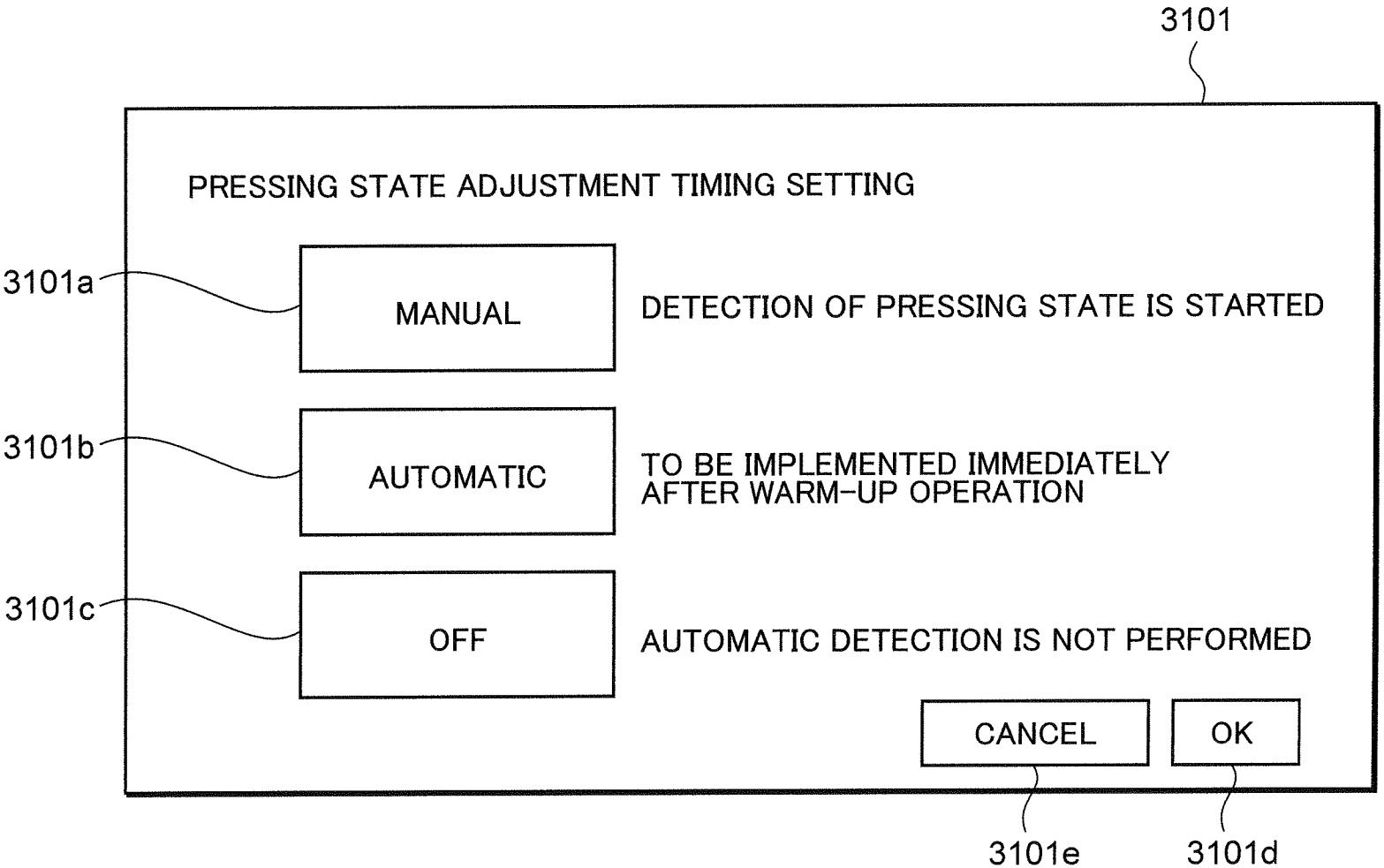
FIG. 15 is a diagram showing an example of the display screen of the display unit.
Figure 16:
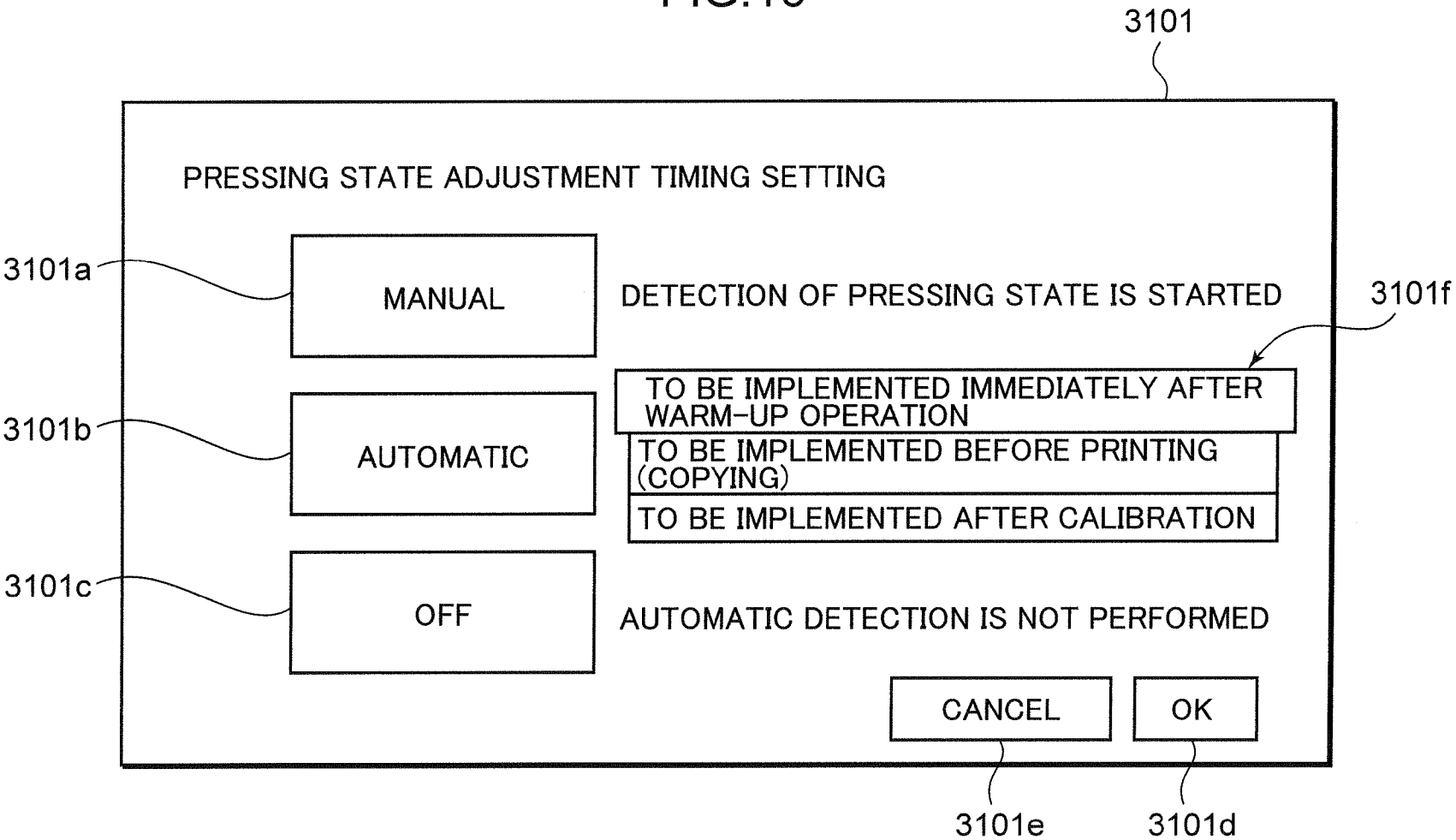
FIG. 16 is a diagram showing an example of the display screen of the display unit.

The setting of the timing of executing the processing (pressing adjustment processing) for adjusting the state that the intermediate transfer belt 10, which is moved by the movement mechanism 100, is pressed by the development units 2M, 2Y, 2C in the multifunction peripheral 1 according to the modified mode of the first embodiment is now explained. FIG. 14 is a flowchart showing the processing flow upon setting the execution timing of the pressing adjustment processing. FIG. 15 and FIG. 16 are diagrams showing an example of the display screen of the display unit 311.

With the multifunction peripheral 1, when the power switch is turned ON, based on the control of the control part 111, an initial screen such as a copy operation reception screen (not shown) is displayed on the display unit 311. In this state, when the user operates the timing setting command input button 314 of the operating unit 310 and the command for starting the setting of the execution timing of the pressing adjustment processing is input by the user (YES in S31), the control part 111 displays the pressing state adjustment timing setting screen 3101 shown in FIG. 15 on the display unit 311 (S32). Note that the screen data of the respective display screens displayed on the display unit 311 is stored in a data storage unit such as a memory provided to the control unit 110.

The pressing state adjustment timing setting screen 3101 displays a manual button 3101*a*, an automatic button 3101*b*, an OFF button 3101*c*, an OK button 3101*d*, and a cancel button 3101*e*.

The manual button 3101*a* is a button where a command to the effect of immediately executing the pressing state adjustment is input by the user as the foregoing time designation command based on the touch panel function according to the pressing operation by the user.

The automatic button 3101*b* is a button where a command to the effect of periodically executing the pressing state adjustment at a predetermined timing is input by the user as the foregoing time designation command based on the touch panel function.

The OFF button 3101*c* is a button where a command to the effect of stopping the execution of the periodical pressing state adjustment at a predetermined timing is input by the user as the foregoing time designation command based on the touch panel function.

The OK button 3101*d* is a button where a command for finalizing the respective commands input by the manual button 3101*a*, the automatic button 3101*b* and the OFF button 3101*c* based on the touch panel function is input by the user.

The cancel button 3101*e* is a button where a command for cancelling the respective commands input by the manual button 3101*a*, the automatic button 3101*b* and the OFF button 3101*c* based on the touch panel function is input by the user.

While the pressing state adjustment timing setting screen 3101 is being displayed, if a command for stopping the execution of the periodical pressing state adjustment at a predetermined timing based on the operation of the OFF button 3101*c* by the user is input (NO in S33), the time designation reception unit 113 receives the foregoing command and stores the setting of stopping the execution of the periodical pressing state adjustment at a predetermined timing (S37).

Meanwhile, while the pressing state adjustment timing setting screen 3101 is being displayed, if a command for designating the timing of performing the pressing state adjustment is input based on the user's operation of the manual button 3101*a* or the automatic button 3101*b* (YES in S33), the time designation reception unit 113 determines whether the foregoing command is a command based on the operation of the manual button 3101*a* or the automatic button 3101*b* (S34), and, if the command to the effect of immediately executing the pressing state adjustment operation was input based on the operation of the manual button 3101*a* ("manual" in S34), the time designation reception unit 113 receives the foregoing command and stores the setting of the timing so that the pressing state adjustment is immediately executed (S36).

Note that, while the pressing state adjustment timing setting screen 3101 is being displayed, if the user operates the automatic button 3101*b* by pressing it downward, the control part 111 changes the display mode of the adjustment execution timing display portion 3101*f* in the pressing state adjustment timing setting screen 3101, and, as shown in FIG. 16, displays, for example, "during warm-up operation" "before printing (copying) (before starting the image forming operation)" "after calibration" and the like as candidates of the timing of executing the pressing state adjustment based on a pull-down display or the like. When the candidates of the timing of executing the pressing state adjustment are displayed on the display unit 311 as described above, when the one of the display portions of the respective candidates is pressed by the user's operation, the timing corresponding to the pressed display portion is input as the time designation command based on the touch panel function, and the time designation reception unit 113 receives such time designation command.

When the time designation reception unit 113 determines that the command input in S33 is a command based on the operation of the automatic button 3101*b* and a command to the effect of periodically executing the pressing state adjustment at a predetermined timing has been input ("automatic" in S34), the time designation reception unit 113 stores the setting (automatic adjustment setting) of the timing indicated in the time designation command that was input as a result of one of the display portions of the respective candidates as the setting (automatic adjustment setting) as the foregoing predetermined timing of executing the periodical pressing state adjustment (S35).

Figure 17:
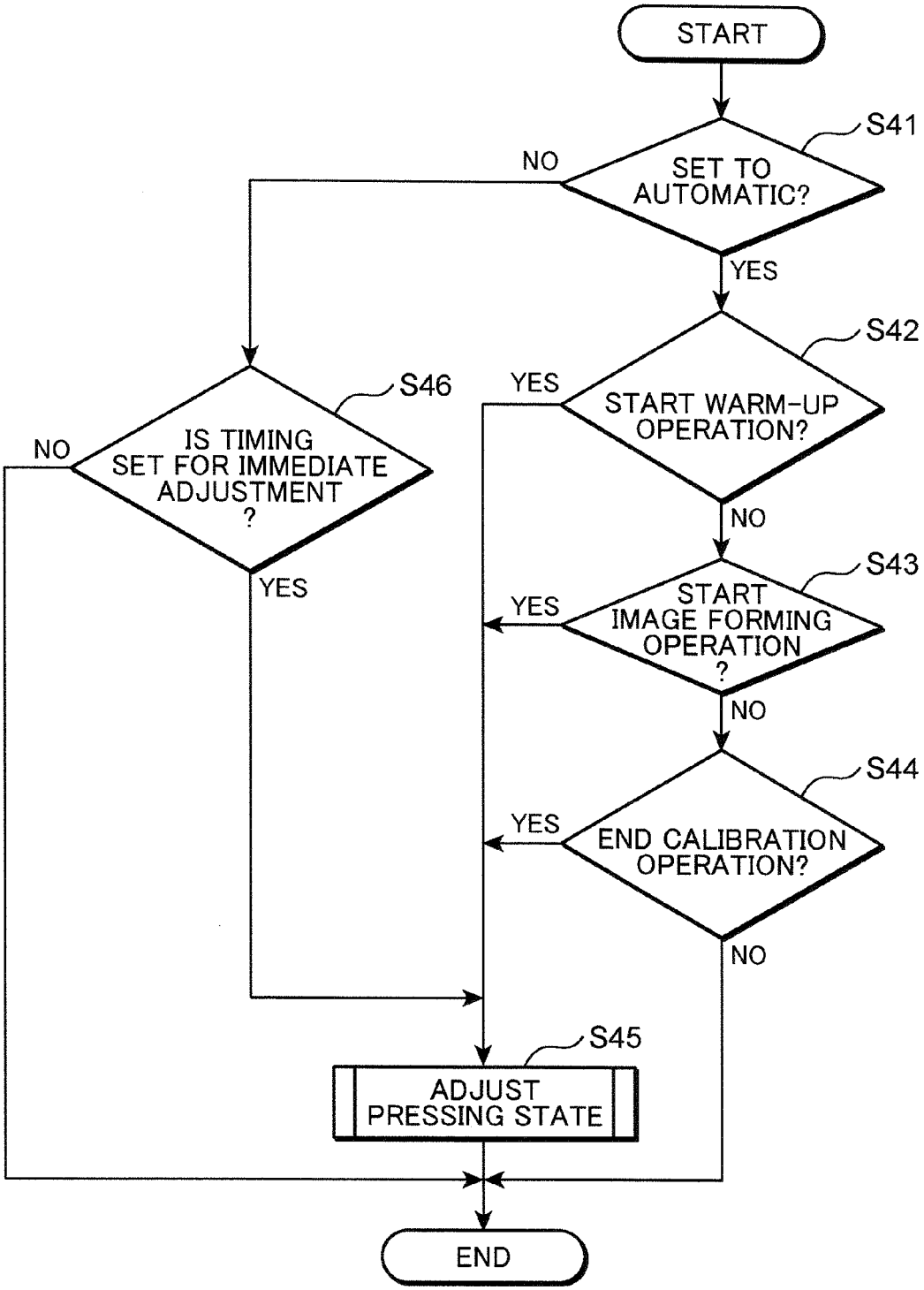
FIG. 17 is a flowchart showing the determination processing of the timing of executing the pressing state adjustment processing.

The determination processing of timing of executing the pressing state adjustment processing is now explained. FIG. 17 is a flowchart showing the determination processing of the timing of executing the pressing state adjustment processing. Note that the details of the pressing state adjustment processing will be described later.

When the power of the multifunction peripheral 1 is turned ON and the multifunction peripheral 1 is in an input standby state of various jobs such as the copying operation, the control part 111 determines whether the setting stored in the time designation reception unit 113 is the foregoing automatic adjustment setting (S41).

Here, if the control part 111 determines that the setting stored in the time designation reception unit 113 is not the foregoing automatic adjustment setting and a timing of immediately executing the pressing state adjustment is set (NO in S41, YES in S46), the pressing state adjustment processing is started immediately at this point in time (S45). Note that, if the control part 111 determines that a timing of immediately executing the pressing state adjustment is not set (NO in S46), the pressing state adjustment is not started, and the processing from S41 is repeated once again.

Meanwhile, if the control part 111 determines that the setting stored in the time designation reception unit 113 is the foregoing automatic adjustment setting (YES in S41), the control part 111 determines whether the operating state of the multifunction peripheral 1 corresponds to during warm-up operation, before printing (copying), or after calibration, and, when the multifunction peripheral 1 corresponds to any one of the above (YES in S42, YES in S43, YES in S44), the pressing state adjustment processing as with the multifunction peripheral 1 of the first embodiment shown in FIG. 6 is started at this point in time (S45).

Moreover, if the operating state of the multifunction peripheral 1 does not correspond to any one among during warm-up operation, before printing (copying), or after calibration (NO in S42, NO in S43, NO in S44), the pressing state adjustment is not started, and the processing from S41 is repeated once again.

Subsequently, with the multifunction peripheral 1 according to this modified mode, the drive control of the movement mechanism 100 during the normal color image forming operation is performed in the same manner as the drive control of the movement mechanism 100 during the normal color image forming operation by the multifunction peripheral 1 of the first embodiment explained with reference to FIG. 10 and FIG. 11.

Note that the movement mechanism 100, the control part 111, the determination unit 112, and the cam position detection sensor 35 in the foregoing first embodiment and its modified mode are respectively examples of the first movement mechanism, the first control part, the first determination unit, and the first pressing state detection unit referred to in the claims.

With a conventional image forming apparatus such as a multifunction peripheral, even if the pressing state sensor detects the pressing state of the photoreceptor drum and the circumferential surface of the intermediate transfer belt, there are cases where the photoreceptor drum and the circumferential surface of the intermediate transfer belt are not actually in a pressing state which is suitable for image formation due to variations in the accuracy during the assembly of the respective components configuring the image formation mechanism or variations in the accuracy of the detection by the pressing state sensor itself. Thus, even if image formation is performed onto the recording paper according to the detection result of the pressing state sensor, there were cases where the planned image quality could not be obtained and unevenness would occur in the image quality between the individual image forming apparatuses.

According to the multifunction peripheral 1 of the foregoing first embodiment, it is possible to accurately determine, at an optimal timing, that the development units 2Bk to 2M are in contact with the intermediate transfer belt 10 in a normal pressing state, thereby reliably obtain the scheduled image quality, and avoid a situation where unevenness occurs in the image quality between the individual the multifunction peripherals 1.

Moreover, according to the multifunction peripheral 1 of the foregoing first embodiment, since the determination unit 112 determines that the stop timing of the movement operation by the movement mechanism 100 in which the concentration shows the maximum value based on the concentration of the respective toner patterns transferred to the intermediate transfer belt 10 and detected by the concentration sensor 18 based on the foregoing plurality of control operations as the stop timing in which the pressing state of the development units 2Bk to 2M and the intermediate transfer belt 10 becomes normal, the timing of starting the drive and stopping the drive of the movement mechanism 100 for causing the pressing state to be normal can be reliably detected.

Moreover, according to the multifunction peripheral 1 of the foregoing first embodiment, since the control part 111 sets the stopped state of the movement operation by the movement mechanism 100 at the stop timing in which the pressing state is determined to be normal by the determination unit 112, as the pressing state of the development units 2Bk to 2M and the intermediate transfer belt 10 upon causing the development units 2Bk to 2M to perform image forming operation, it is possible to cause the development units 2Bk to 2M and the intermediate transfer belt 10 to reliably perform normal image formation.

Moreover, according to the multifunction peripheral 1 of the foregoing first embodiment, since the pressing state determination operation is executed at the timing indicated in the time designation command received by the time designation reception unit 113 from the user, it is possible to determine whether the pressing state of the development units 2Bk to 2M and the intermediate transfer belt 10 is normal at the user's intended timing.

Moreover, according to the multifunction peripheral 1 according to the modified mode of the first embodiment, the user can immediately execute the pressing state determination operation at the user's intended timing based on the time designation reception unit 113.

Moreover, according to the multifunction peripheral 1 according to the modified mode of the first embodiment, since the time designation reception unit 113 receives a command to the effect of periodically executing the pressing state determination operation at a predetermined timing from the user as the foregoing determination operation execution time, the user can periodically execute the pressing state determination operation without having to issue a command each time the pressing state determination operation is to be performed.

Moreover, according to the multifunction peripheral 1 according to the modified mode of the first embodiment, since the time designation reception unit 113 receives the determination operation execution time from the user using, as the predetermined timing, at least one among during the warm-up operation of the multifunction peripheral 1, before starting the image forming operation by the development units 2Bk to 2M, or after executing the calibration, and the pressing state determination operation can be periodically and reliably executed at the timing that the foregoing pressing state determination operation is deemed necessary without the user having to issue a command for each such occasion.

The multifunction peripheral 1 as the second embodiment of the image forming apparatus according to the present invention is now explained. Since the schematic configuration of the multifunction peripheral 1 of the second embodiment is basically the same as the multifunction peripheral 1 of the first embodiment explained with reference to FIG. 1 to FIG. 4, the explanation of the same configuration is omitted and the differences in the multifunction peripheral 1 according to the second embodiment are mainly explained.

Figure 18:
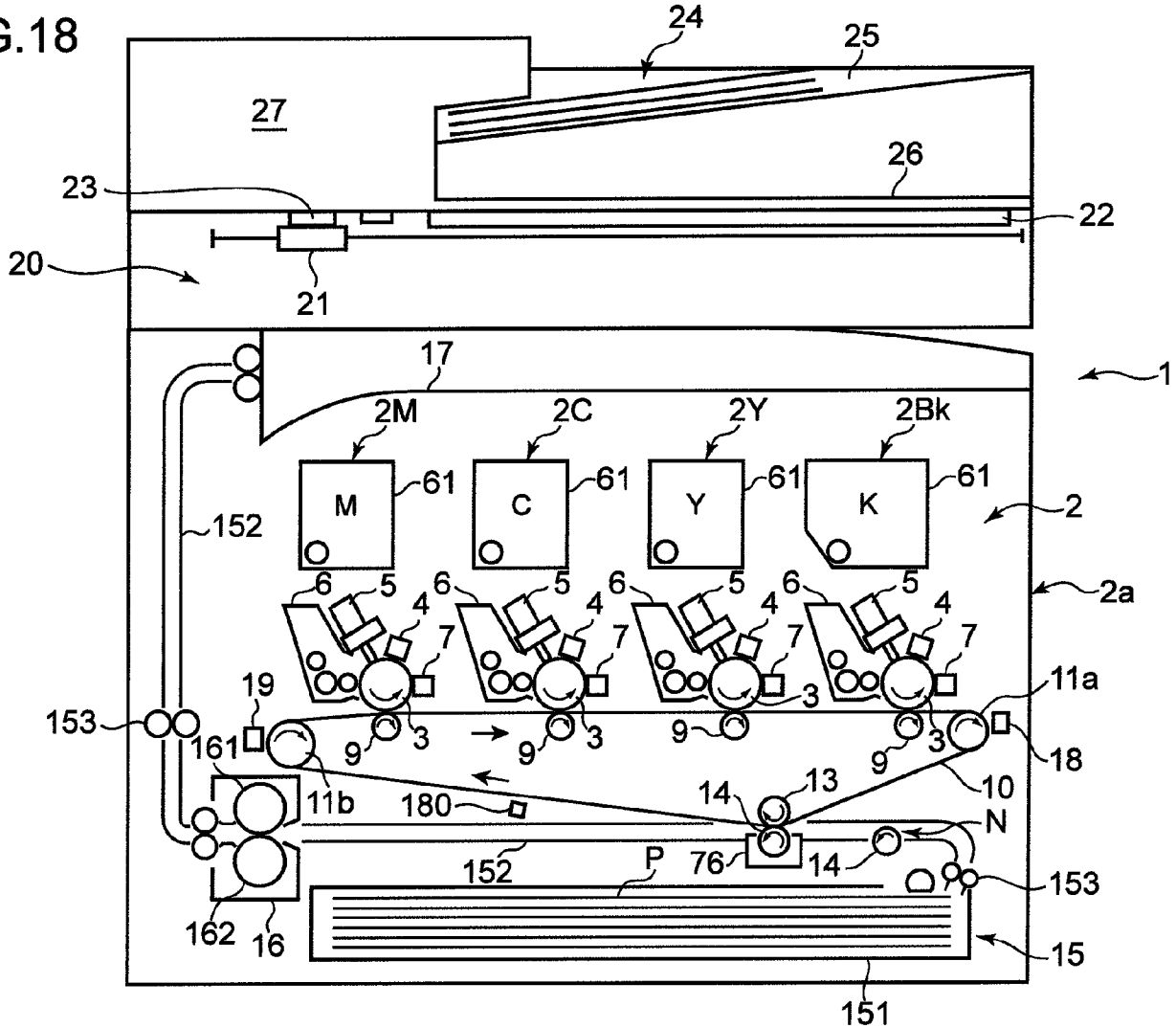
FIG. 18 is a front cross section showing the structure of a multifunction peripheral according to the second embodiment.

In the second embodiment, as shown in FIG. 18, a movement mechanism 76 for moving the secondary transfer roller 14 in a direction of coming in contact with and separating from the intermediate transfer belt 10 is provided in substitute for the movement mechanism 100 in the first embodiment. Details concerning the movement mechanism 76 will be explained later with reference to FIG. 19 and FIG. 20, and FIG. 18 only shows the outline of the movement mechanism 76.

Moreover, in the second embodiment, the concentration sensor 18 is used for detecting the concentration of the toner pattern formed on the intermediate transfer belt 10 by at least one of the development units 2M, 2Y, 2C, 2Bk and the corresponding transfer roller 9 upon performing the pressing state adjustment of the secondary transfer roller 14 described later and the intermediate transfer belt 10 in addition to detecting the concentration of the toner pattern during calibration. Nevertheless, the concentration sensor for the pressing state adjustment of the secondary transfer roller 14 and the intermediate transfer belt 10 may be provided separately from the concentration sensor 18 for calibration.

The configuration of the control system of the multifunction peripheral 1 according to the second embodiment is now explained with reference to FIG. 4 mainly regarding the differences with the multifunction peripheral 1 of the first embodiment.

In the second embodiment, the second bias applying part of the bias applying part 32 constitutes a part of the secondary transfer roller part referred to in the claims.

Figure 19:
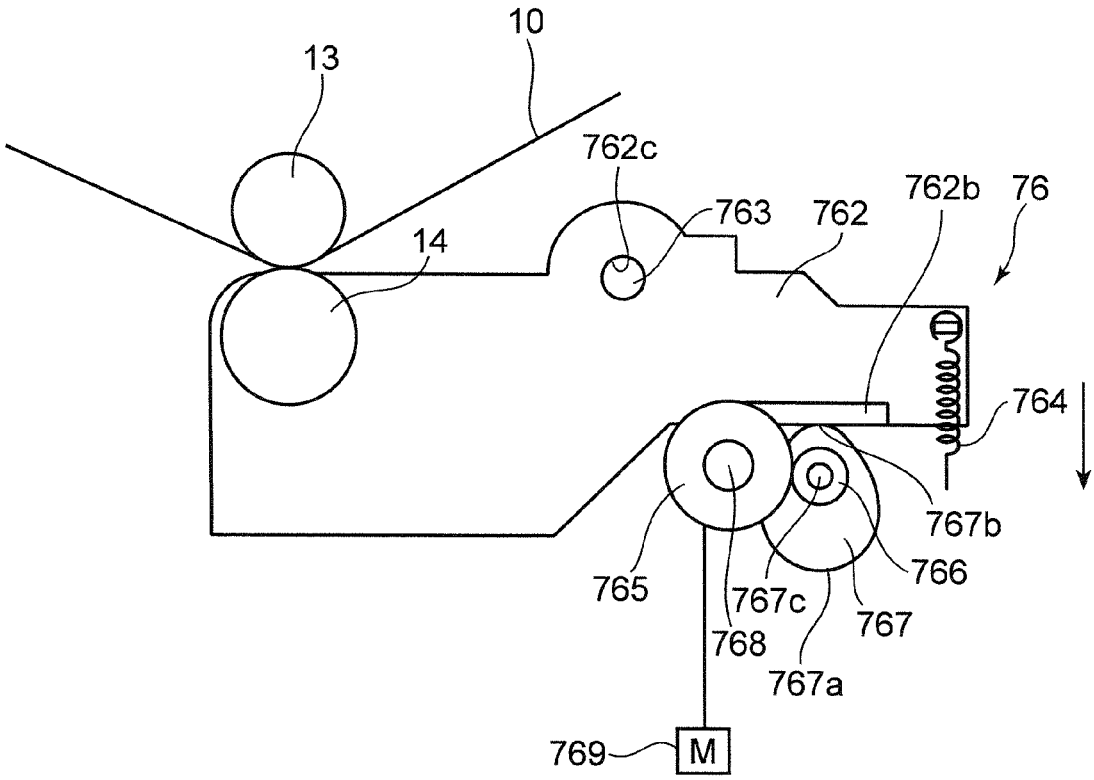
FIG. 19 is a schematic diagram showing the movement mechanism provided to the intermediate transfer belt in the multifunction peripheral according to the second embodiment, and a diagram showing a posture where the secondary transfer roller is pressed by the intermediate transfer belt.
Figure 20:
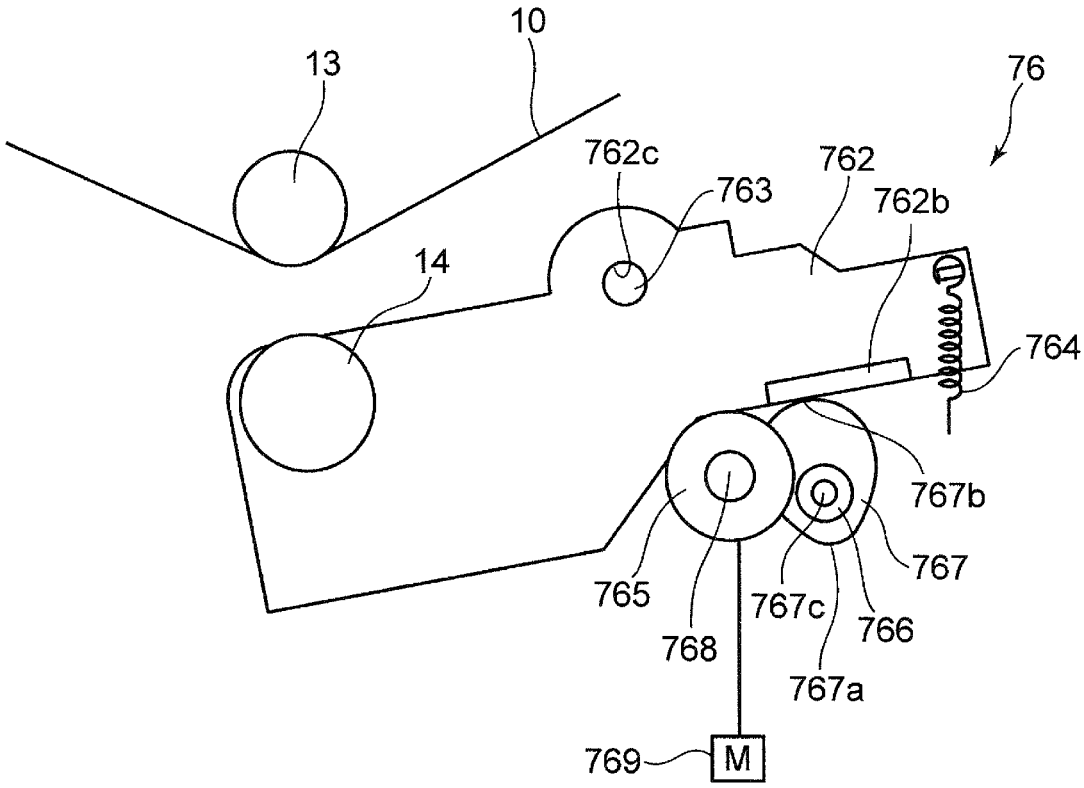
FIG. 20 is a schematic diagram showing the movement mechanism provided to the intermediate transfer belt in the multifunction peripheral according to the second embodiment, and a diagram showing a posture where the secondary transfer roller is separated from the intermediate transfer belt.

Note that FIG. 19 and FIG. 20 only show the mechanism concerning the adjustment processing of the contact state (pressing state) of the secondary transfer roller 14 and the intermediate transfer belt 10.

Moreover, the control part 111 controls the driving motor (collective designation of the respective driving sources) 500 as the respective driving sources of the secondary transfer roller 14, the intermediate transfer belt 10, the image forming unit 2, the fixation device 16 and the movement mechanism 76 described later.

During the pressing state adjustment of the secondary transfer roller 14 and the intermediate transfer belt 10, the control part 111 drives the image forming unit 2, the driving motor 500 and the like and causes at least one among the development units 2M, 2Y, 2C, 2Bk, for example, the magenta development unit 2M of the image forming unit 2, to form a toner pattern tp respectively in the vicinity of both ends in the width direction on the intermediate transfer belt 10 (same as the example shown in FIG. 2). In addition, the control part 111 performs the toner pattern transfer control of causing the secondary transfer roller 14 to transfer the toner pattern tp on the circumferential surface of the intermediate transfer belt 10 toward the secondary transfer roller 14, and once again transferring the toner pattern tp from the secondary transfer roller 14 to the intermediate transfer belt 10. Note that, in the second embodiment, the development unit 2M forming the toner pattern tp and the concentration and shape of the toner pattern tp are the same as the case of the first embodiment. The concentration of the toner pattern tp is detected by the concentration sensor 18.

The determination unit 112 determines whether the concentration of the toner pattern on the circumferential surface of the intermediate transfer belt 10 that was detected by the concentration sensor 18 has reached a predetermined concentration value (normal value), and, if it is determined that this condition has been satisfied, determines that the state where the intermediate transfer belt 10 is being pressed by the secondary transfer roller 14 is normal.

When the determination unit 112 determines that the state where the intermediate transfer belt 10 is being pressed by the secondary transfer roller 14 is not normal, the control part 111 causes the display unit 311 to issue a warning to the user.

Specifically, in the case of image formation based on the secondary transfer method using the intermediate transfer belt 10, if the contact of the secondary transfer roller 14 and the intermediate transfer belt 10 is insufficient or excessive and a nip part of an appropriate pressing state is not formed between the secondary transfer roller 14 and the intermediate transfer belt 10 when the toner pattern is transferred from the development unit 2M to the intermediate transfer belt 10, the transfer of the toner image from the intermediate transfer belt 10 to the secondary transfer roller 14 becomes insufficient, and, therefore, even if the toner pattern tp transferred onto the secondary transfer roller 14 is once again transferred onto the intermediate transfer belt 10, the concentration of the toner pattern tp that is returned onto the intermediate transfer belt 10 becomes low. Based on the above, in this embodiment, after the foregoing toner pattern tp is transferred bidirectionally to the intermediate transfer belt 10 and the secondary transfer roller 14, if the concentration of the toner pattern that is detected by the concentration sensor 18 has reached the predetermined concentration value, then the determination unit 112 determines that the pressing state of the secondary transfer roller 14 and the intermediate transfer belt 10 is normal.

The movement mechanism of moving the secondary transfer roller 14 in a direction of coming in contact with and separating from the intermediate transfer belt 10 is now explained. FIG. 19 is a schematic diagram showing the movement mechanism provided to the intermediate transfer belt, and is a diagram showing the posture of the secondary transfer roller being pressed by the intermediate transfer belt. FIG. 20 is a schematic diagram showing the movement mechanism provided to the intermediate transfer belt, and is a diagram showing the posture where the secondary transfer roller is separated from the intermediate transfer belt.

The movement mechanism 76 is a mechanism for moving the secondary transfer roller 14 in a direction of coming in contact with and separating from the intermediate transfer belt 10. As shown in FIG. 19 and FIG. 20, the movement mechanism 76 is disposed below the intermediate transfer belt 10 portion which is tightly stretched across the secondary transfer opposing roller 13.

Moreover, the movement mechanism 76 comprises a support frame 762, a rotating axis 763, a coil spring 764, a first gear 765, a rotating axis 768, a second gear 766, a cam 767, and a driving motor 769.

The secondary transfer roller 14 is disposed opposite to the secondary transfer opposing roller 13 with the intermediate transfer belt 10 positioned therebetween, and pinches the sheet with the intermediate transfer belt 10 at the transfer position (position of pressing the intermediate transfer belt 10) on the side that is closest to the intermediate transfer belt 10. Here, the secondary transfer roller 14 can be positioned at the foregoing transfer position (position of FIG. 19) and the separated position (position of FIG. 20) that is farthest from the intermediate transfer belt 10.

The support frame 762 is a member for rotatably supporting the secondary transfer roller 14, and is a plate-shaped member extending in one direction. Moreover, the support frame 762 rotatably and axially supports the secondary transfer roller 14 at the upper part of one end thereof, and a coil spring 764 is mounted at the upper part of the other end thereof. In addition, the support frame 762 includes a contact portion 762*b* at the lower part thereof for coming in contact with the cam 767, and a through-hole 762*c* is provided at the upper part thereof approximately in the middle of the length direction, and the through-hole 762*c* rotatably supports the rotating axis 763 for rotating the support frame 762. The rotating axis 763 is disposed so as to penetrate the through-hole 762*c*. Moreover, the rotating axis 763 is mounted rotatably on a frame not shown of the movement mechanism 76. Note that the support frame 762 axially supports the secondary transfer roller 14 at both ends in the axial direction of the rotating axis thereof.

The coil spring 764 is configured from an extension spring or the like, and applies biasing force to the support frame 762 for moving the secondary transfer roller 14 in a direction of approaching the intermediate transfer belt 10. Specifically, the coil spring 764 biases the other end of the support frame 762 downward in the diagrams (right-side end of FIG. 19 and FIG. 20). When the other end of the support frame 762 is biased downward, it is rotated around the rotating axis 763 of the support frame 762, and the end side which is axially supporting the secondary transfer roller 14 moves upward. Specifically, the secondary transfer roller 14 moves toward the intermediate transfer belt 10.

The first gear 765 is a member that is mounted on the rotating axis 768, and is engaged with a second gear 766 of the cam 767. The first gear 765 rotates pursuant to the rotation of the rotating axis 768.

The second gear 766 is disposed in alignment with the first gear 765, and rotates pursuant to the rotation of the first gear 765.

The cam 767 is a member for moving the secondary transfer roller 14 away from the intermediate transfer belt 10 by pushing the support frame 762 upward, and is disposed so that it can come in contact with the contact part 762*b* of the support frame 762. Moreover, the cam 767 is a member that is mounted on the rotating axis 768 of the second gear 766, and rotates pursuant to the rotation of the second gear 766. In addition, the cam 767 is an oval member, and a first portion 767*a* and a second portion 767*b* which are of respectively different distances from the rotating axis 767*c* switch positions each time they rotate 180° based on the rotational driving force of the driving motor 769.

The rotating axis 768 is a member for rotating the first gear 765 and a member extending in a direction that is approximately orthogonal to the support frame 762.

Moreover, the cam drive axis 767*c* of the cam 767 is extending in the rotating axis direction of the secondary transfer roller 14. The cam 767 is disposed at the location of the cam drive axis 767*c* capable of pressing the support frame 762 in the rotating axis direction. A cam position detection sensor (pressing state detection unit) 35 for detecting the posture of the cam 767 which rotates pursuant to the cam drive axis 767*c* is mounted on the bottom face of the support frame 762 or the apparatus body 2*a* in the vicinity of the position where the cam 767 is disposed. The cam position detection sensor 35 comprises a light-emitting part 35*a* and a light-receiving part 35*b*. The light-emitting part 35*a* is provided to one side of the cam 767 with the cam 767 positioned therebetween, and the light-receiving part 35*b* is provided to the other side of the cam 767. The light-emitting part 35*a* and the light-receiving part 35*b* are disposed, for example, at the bottom face of the support frame 762 or above the apparatus body 2*a* such that when the cam 767 is rotated by the cam drive axis 767*c* and becomes eccentric, and as a result assumes a posture within a fixed range before and after the posture shown in FIG. 19 (from the secondary transfer roller 14 reaching a state of pressing the intermediate transfer belt 10 due to the change in the eccentricity associated with the rotation of the cam 767 until such pressing state is released due to the change in the eccentricity associated with the further rotation of the cam 767), the light that is emitted by the light-emitting part 35*a* is blocked by the cam part 102*b* and is not received by the light-receiving part 35*b*, and such that when the cam 767 assumes a posture other than the posture shown in FIG. 19, the light that is emitted by the light-emitting part 35*a* is not blocked by the cam 767 and is received by the light-receiving part 35*b*. The cam position detection sensor 35 (pressing state detection unit) 35 is shown in FIG. 4 referred to in the second embodiment.

The cam position detection sensor 35 sends a cam detection signal to the control part 111 when the light-receiving part 35*b* is not receiving the light from the light-emitting part 35*a*. Specifically, the cam detection signal is sent when the cam 767 is rotated by the cam drive axis 767*c* and becomes eccentric and enters a state that is similar to the posture shown in FIG. 19, the support frame 762 approaches the intermediate transfer belt 10 and the intermediate transfer belt 10 becomes pressed by the secondary transfer roller 14 above the support frame 762. Thus, the cam detection signal is a pressing state detection signal showing that the intermediate transfer belt 10 is in a state of being pressed by the secondary transfer roller 14 (pressing state of the intermediate transfer belt 10 and the secondary transfer roller 14 is in a state of the color image forming operation).

Figure 21:
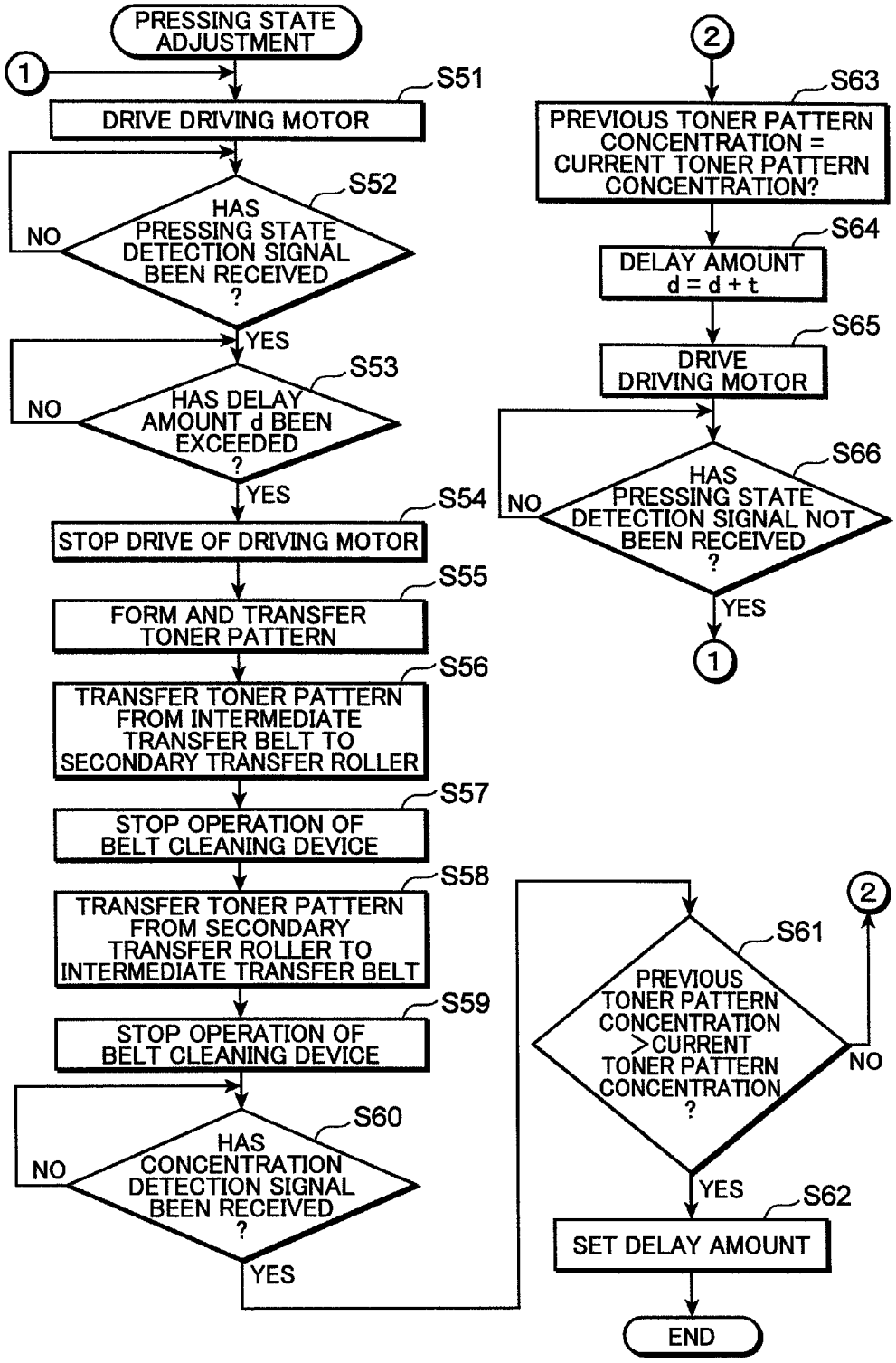
FIG. 21 is a flowchart showing the first example of the adjustment processing of a state where the intermediate transfer belt is being pressed by the r secondary transfer roller in the multifunction peripheral according to the second embodiment.
Figure 22:
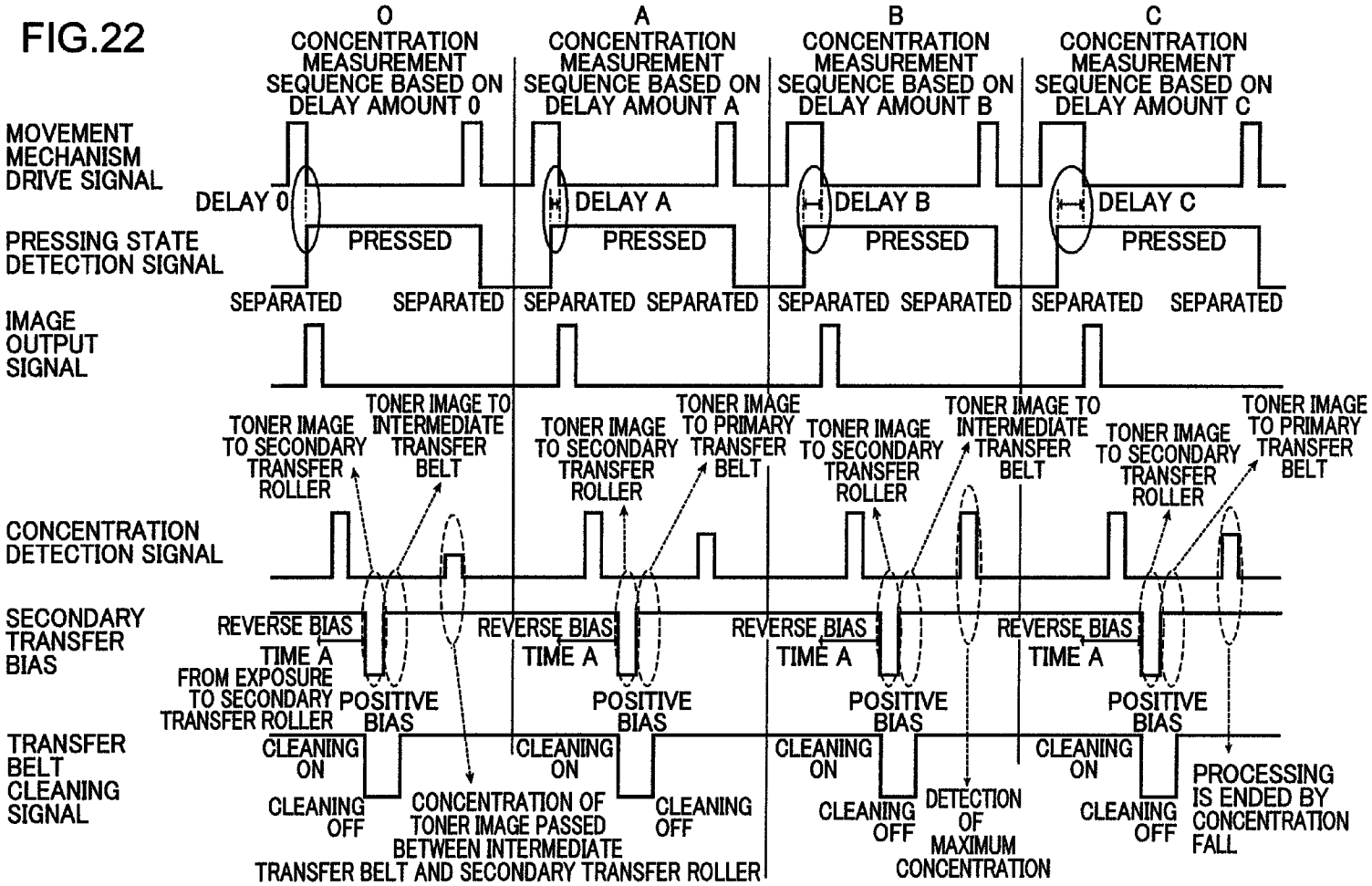
FIG. 22 is a timing chart of a drive signal of the driving motor of the movement mechanism during the adjustment processing of the pressing state of the intermediate transfer belt and the secondary transfer roller, a detection signal from the cam position detection sensor, an image output signal that is output to the development unit, and a timing chart of the concentration detection signal from the concentration sensor.

The first example of the adjustment processing of a state where the intermediate transfer belt 10 is pressed by the secondary transfer roller 14 performed by the multifunction peripheral 1 according to the second embodiment is now explained. FIG. 21 is a flowchart showing the first example of the adjustment processing of a state where the intermediate transfer belt 10 is pressed by the secondary transfer roller 14. FIG. 22 is a timing chart of the drive signal of the driving motor 769 of the movement mechanism 76 during the adjustment processing of the pressing state of the intermediate transfer belt 10 and the secondary transfer roller 14, the detection signal from the cam position detection sensor 35, the image output signal that is output to the development unit 2M, the concentration detection signal from the concentration sensor 18, the bias applying signal of applying a secondary transfer bias to the second bias applying part of the bias applying part 32, and the drive signal for causing the belt cleaning device 19 to perform belt cleaning.

As described above, with the multifunction peripheral 1, based on the control of the control part 111, the movement mechanism 76 moves the secondary transfer roller 14 between the position where the secondary transfer roller 14 presses the intermediate transfer belt 10 and the position of separating the secondary transfer roller 14 from the intermediate transfer belt 10.

Subsequently, when the movement mechanism 76 is to rotate the support frame 762 for moving the secondary transfer roller 14 to the position of pressing the intermediate transfer belt 10, with the initial setting of the multifunction peripheral 1, as with the example shown in FIG. 7, the control part 111 is set to send a drive signal to the driving motor 769 and rotates the support frame 762 with the rotation of the gear 765 and the cam 767 based on the rotational driving force of the driving motor 769, and, upon receiving the pressing state detection signal that is output from the foregoing cam position detection sensor (example of the pressing/separation detection unit) 35, stop the sending of the drive signal to the driving motor 769. Specifically, at the position upon receiving the pressing state detection signal from the cam position detection sensor 35, the intermediate transfer belt 10 becomes a state of being pressed by the secondary transfer roller 14.

In this pressing state adjustment processing, the degree of the intermediate transfer belt 10 being pressed by the secondary transfer roller 14 is adjusted based on the movement operation performed by the movement mechanism 76. Upon adjusting the degree of the intermediate transfer belt 10 being pressed by the secondary transfer roller 14, foremost, the control part 111 sends a drive signal to the driving motor 769 and drives the driving motor 769 (S51), rotates the support frame 762 with the rotation of the gear 765 and the cam 767 based on the rotational driving force of the driving motor 769, and moves the support frame 762 in a state where the secondary transfer roller 14 is separated from the intermediate transfer belt 10 (FIG. 20) to a state where the secondary transfer roller 14 presses the intermediate transfer belt 10 (FIG. 19).

Subsequently, the control part 111 determines whether the intermediate transfer belt 10 is being pressed by the secondary transfer roller 14 based on the pressing state detection signal from the cam position detection sensor 35 (S52). When the control part 111 receives the pressing state detection signal from the cam position detection sensor 35 (YES in S52), it determines that the intermediate transfer belt 10 is being pressed by the secondary transfer roller 14, and measures whether a predetermined delay amount (delay time from the time of receiving the pressing state detection signal, wherein the delay amount d=0 (msec) during the initial drive of the driving motor 769 (delay amount 0 of FIG. 22), and the subsequent delay amount shall be obtained by adding a predetermined time t (msec) to the delay amount d) has elapsed by using a timer or the like built into the control part 111 (S53). When the control part 111 measures the lapse of the delay amount from the time of receiving the pressing state detection signal (YES in S53), the sending of the drive signal to the driving motor 769 is stopped at this time, and the drive of the driving motor 769 is stopped (S54). Note that, as shown in FIG. 22, the timing of stopping the sending of the drive signal of the driving motor 769 in the first instance will be at the time of receiving the pressing state detection signal.

In addition, as shown in FIG. 22, the control part 111 drives the development unit 2M in the traveling direction of the intermediate transfer belt 10 so as to form a toner pattern tp at the time of stopping the drive of the driving motor 769, and further transfers the toner pattern tp to the intermediate transfer belt 10 (S55).

Note that the concentration sensor 18 thereafter detects the concentration of the toner pattern tp, but this detection value is not used in this pressing state adjustment processing.

Subsequently, the control part 111 outputs a bias applying signal for applying a secondary transfer bias to the second bias applying part of the bias applying part 32 at the timing in which the toner pattern tp that was transferred onto the intermediate transfer belt 10 is transported to the position opposite to the secondary transfer roller 14 based on the travel of the intermediate transfer belt 10 (S56). Consequently, the toner pattern tp on the intermediate transfer belt 10 is transferred to the secondary transfer roller 14, and moved toward the secondary transfer roller 14.

Note that the control part 111 stops the output of the drive signal for performing the belt cleaning to the belt cleaning device 19 approximately at the same time as outputting the foregoing bias applying signal (S57).

In addition, after the transfer of the toner pattern tp on the intermediate transfer belt 10 toward the secondary transfer roller 14 is complete, the control part 111 stops the output of the bias applying signal to the second bias applying part of the bias applying part 32 (S58), transfers the toner pattern tp that was transferred toward the secondary transfer roller 14 toward the intermediate transfer belt 10, and thereby once again transfers the toner pattern tp to the intermediate transfer belt 10.

The control part 111 stops the output of the drive signal to the belt cleaning device 19 until the toner pattern tp that was returned once again to the intermediate transfer belt 10 passes through the cleaning position by the belt cleaning device 19 based on the travel of the intermediate transfer belt 10 (S59), and resumes the output of the drive signal to the belt cleaning device 19 once again at the timing after the toner pattern tp passes through the cleaning position.

The foregoing toner pattern tp is transferred to the concentration detection position of the concentration sensor 18 based on the travel of the intermediate transfer belt 10. When the toner pattern tp is transferred to the concentration detection position of the concentration sensor 18 and the concentration detection is performed by the concentration sensor 18 (YES in S60), the determination unit 112 determines whether the condition of the detected toner pattern concentration being less than the previously detected toner pattern concentration has been satisfied based on the concentration detection signal that is received from the concentration sensor 18 (S61). Note that the determination unit 112 uses the concentration value showing the lowest concentration as the previously detected toner pattern concentration during the initial determination.

Here, if the determination unit 112 determines that the detected toner pattern concentration is greater than the previously detected toner pattern concentration (NO in S61), the determination unit 112 stores the currently detected toner pattern concentration as the previously detected toner pattern concentration for use in the subsequent determination in S61 (S63). During the initial determination, the result will be NO in S61, and the routine proceeds to S63.

Then, the control part 111 sets the delay amount d for use in subsequently measuring the delay amount in S53 to delay amount d=d+t (msec) (S64, delay amount A of FIG. 22). The control part 111 thereafter sends a drive signal to the driving motor 769 to drive the driving motor 769 (S65), rotates the support frame 762 with the gear 765 and the cam 767, and moves the secondary transfer roller 14 from the position of pressing the intermediate transfer belt 10 to the direction of being separated from the intermediate transfer belt 10. At the time that the control part 111 no longer receives the pressing state detection signal from the cam position detection sensor 35 and the secondary transfer roller 14 is separated from the intermediate transfer belt 10 (YES in S66), the processing returns to S51.

Subsequently, the control part 111 once again starts the processing of S51 onward, and, upon receiving the pressing state detection signal from the cam position detection sensor 35 (YES in S52), determines whether a predetermined delay amount from the foregoing reception by using the delay amount d=d+t (msec) set in S63 (S53, delay amount B of FIG. 22). The processing of S54 to S61 is similarly performed as with the initial processing. In S61, if the determination unit 112 determines that the detected toner pattern concentration is greater than the previously detected toner pattern concentration (NO in S61), the processing of S63 to S66 is repeated once again. In S63, the determination unit 112 sets the currently detected toner pattern concentration as the previously detected toner pattern concentration for use in the subsequent determination in S61.

The processing of S51 to S66 is repeated as described above (as shown in FIG. 22, in S53, for example, this becomes delay amount 0, A, B, C . . . ), and, in the processing of S61, if the determination unit 112 determines that the detected toner pattern concentration is less than the previously detected toner pattern concentration as shown with the sequence C of FIG. 22 (YES in S61), the control part 111 stores the delay amount d that was used in the processing of S53 that was performed previous to the current S53 (for example, the delay amount B of the sequence B of FIG. 22) in a built-in memory or the like (S62), and configures the setting so that the color image forming operation by the development units 2M, 2C, 2Y, 2Bk, the transfer roller 9 and the secondary transfer roller 14 is performed in a state where the movement operation by the movement mechanism 76 is stopped at the point in time when the stored delay amount d has elapsed from the time that the cam position detection sensor 35 detects that the intermediate transfer belt 10 is being pressed by the secondary transfer roller 14 upon driving the driving motor 769 during the normal color image forming operation.

Specifically, when the concentration of the toner pattern that is detected by the concentration sensor 18 has reached a predetermined concentration value (normal value) after the transfer of the toner pattern to the intermediate transfer belt 10 and the bidirectional transfer of the toner pattern tp between the intermediate transfer belt 10 and the secondary transfer roller 14 based on the control of the control part 111, the determination unit 112 determines that the pressing state of the secondary transfer roller 14 and the intermediate transfer belt 10 moved by the movement mechanism 76 at such point in time is a normal pressing state. The foregoing predetermined concentration value (normal value) is a value showing a concentration that is higher than a state that the driving motor 769 was stopped at a different delay amount.

Note that, in the foregoing explanation, the control part 111 drives the development unit 2M at the time that the drive of the driving motor 769 is stopped to form a toner pattern tp and transfers such toner pattern tp to the intermediate transfer belt 10 with the transfer roller 9 (S55), and the subsequent photoreceptor drum processing is performed based on the toner pattern tp that was transferred onto the circumferential surface of the intermediate transfer belt 10 by the development unit 2M. However, the control part 111 may also be set to use the respective delay amounts d of S53 and drive the development units 2M, 2Y, 2C, 2Bk in S55 to cause them to respectively form a toner pattern tp and transfer such toner pattern tp to the intermediate transfer belt 10, perform each of the subsequent processing based on the respective toner patterns tp that were transferred onto the circumferential surface of the intermediate transfer belt 10 by the development units 2M, 2Y, 2C, 2Bk, and, when the determination unit 112 determines that the currently detected concentration of all toner patterns is less than the previously detected toner pattern concentration in the processing of S57 regarding all toner patterns tp (YES in S61), the control part 111 stores the delay amount d that was used in the processing of S53 previous to the foregoing S53 (S62), and performs the color image forming operation by the development units 2M, 2C, 2Y, 2Bk in a state where the movement operation by the movement mechanism 76 is stopped at the point in time that the stored delay amount d elapses from the time that the cam position detection sensor 35 detects that the intermediate transfer belt 10 is being pressed by the secondary transfer roller 14 upon driving the driving motor 769 during the normal color image forming operation.

The drive control of the movement mechanism 76 during the normal image forming operation is now explained with reference to FIG. 10 and FIG. 11.

When the secondary transfer roller 14 is to be moved by the movement mechanism 76, the control part 111 foremost sends a drive signal to the driving motor 769 and drives the driving motor 769 (S21), rotates the support frame 762 with the gear 765 and the cam 767, and moves the secondary transfer roller 14 toward the intermediate transfer belt 10 based on the support frame 762.

Subsequently, when the control part 111 receives a pressing state detection signal from the cam position detection sensor 35 (YES in S22), the control part 111 determines whether the delay amount d stored by the control part 111 in the processing of S12 shown in FIG. 21 based on measurement using a built-in timer or the like, and, as shown in FIG. 11, at the point of measuring the delay amount d (YES in S23), stops sending the drive signal to the driving motor 769 and stops the drive of the driving motor 769 (S24).

The control part 111 thereafter causes the development units 2M, 2C, 2Y, 2Bk or only the development unit 2Bk to perform the image forming operation in a state where the intermediate transfer belt 10 is pressed by the secondary transfer roller 14 at the time that the driving motor 769 is stopped based on the color or black-and-white image formation job that was input by an operator using an operating unit not shown.

Figure 23:
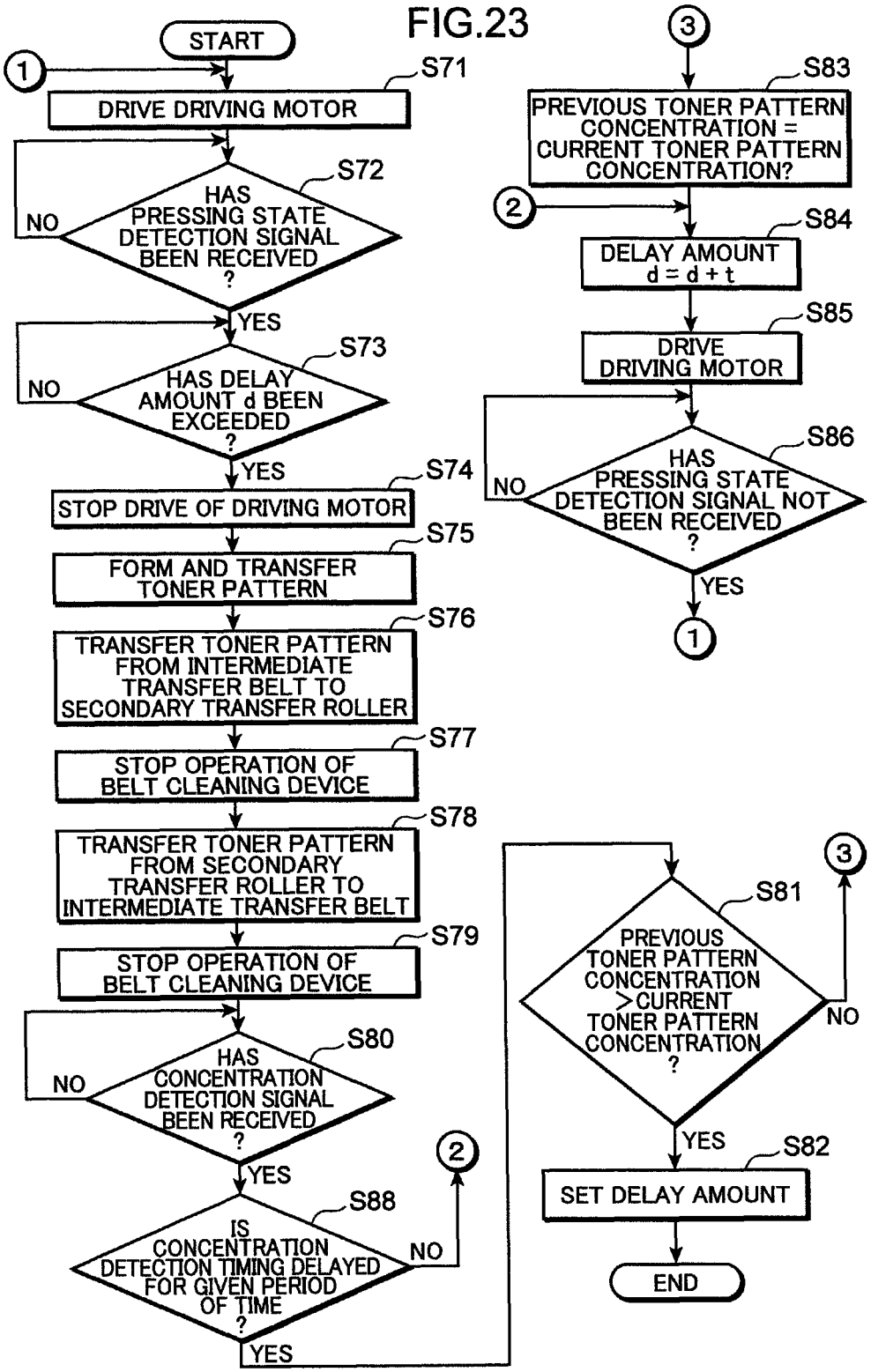
FIG. 23 is a flowchart showing the second example of the adjustment processing of a state where the intermediate transfer belt is being pressed by the secondary transfer roller in the multifunction peripheral according to the second embodiment.

Note that the multifunction peripheral 1 according to the second embodiment is not limited to the foregoing configuration an may be modified variously. A second example of the adjustment processing of a state where the intermediate transfer belt 10 is pressed by the secondary transfer roller 14 is explained below. FIG. 23 is a flowchart showing the second example of the adjustment processing of a state where the intermediate transfer belt 10 is pressed by the secondary transfer roller 14. Note that the explanation of the same processing as the first example is omitted.

In the second embodiment, after the concentration detection of the toner pattern tp by the concentration sensor 18 is performed in S80, the determination unit 112 further determines whether the timing of detecting the concentration of the toner pattern tp by the concentration sensor 18 is delayed by a predetermined time that is required for the bidirectional toner pattern transfer between the intermediate transfer belt 10 and the secondary transfer roller 14 performed in S76 and S78 than the timing that the toner pattern reaches the concentration detection position of the concentration sensor 18 based on the endless traveling of the intermediate transfer belt 10 after the toner pattern is transferred to the intermediate transfer belt 10 by the development unit 2M and the transfer roller 9 (S88).

Note that the foregoing predetermined time is stored in a memory or the like built into the determination unit 112 upon the manufacturer measuring the time required for the bidirectional transfer of the toner pattern tp between the intermediate transfer belt 10 and the secondary transfer roller 14 prior to the multifunction peripheral 1 being shipped from the plant.

When the determination unit 112 determines that the foregoing condition is not satisfied (NO in S88), the processing proceeds to S84. Specifically, the determination unit 112 does not perform the processing of storing the currently detected toner pattern concentration in S83 as the previously detected toner pattern concentration for use in subsequent S81, and the processing of S84 is performed by the control part 111.

Subsequently, the foregoing delay amount d is increased by performing the processing of S84 to S86, and the processing of S71 onward is repeated once again.

When the determination unit 112 determines that the foregoing condition is satisfied (YES in S88), it further performs the determination of S81.

Specifically, in this second example, if the toner pattern tp on the intermediate transfer belt 10 is not transferred toward the secondary transfer roller 14 simply because the contact of the secondary transfer roller 14 and the intermediate transfer belt 10 is insufficient, and, without being returned to the intermediate transfer belt 10 once again, reaches the concentration detection position of the concentration sensor 18 and the concentration of the toner pattern tp has reached the predetermined concentration value (normal value), the pressing state of the secondary transfer roller 14 and the intermediate transfer belt 10 is not determined to be normal. Consequently, the determination of whether the pressing state of the secondary transfer roller 14 and the intermediate transfer belt 10 is normal can be performed accurately.

Moreover, in each of the foregoing embodiments, a second concentration sensor which detects the concentration of the toner pattern tp for the pressing state adjustment processing of the secondary transfer roller 14 and the intermediate transfer belt 10 may be provided separately from the concentration sensor 18 for calibration. In the foregoing case, by disposing the second concentration sensor 180 at the position shown in FIG. 18, the concentration of the toner pattern tp after the bidirectional transfer between the intermediate transfer belt 10 and the secondary transfer roller 14 can be detected immediately. Specifically, it is no longer necessary to perform the processing of using the concentration of the toner pattern tp detected by the concentration sensor 18 after the processing of S55 that is not used in the pressing state adjustment processing explained in the pressing state adjustment processing according to the first example, and the concentration of the toner pattern tp that was detected by the second concentration sensor 180 can be used in the determination of S81.

Figure 24:
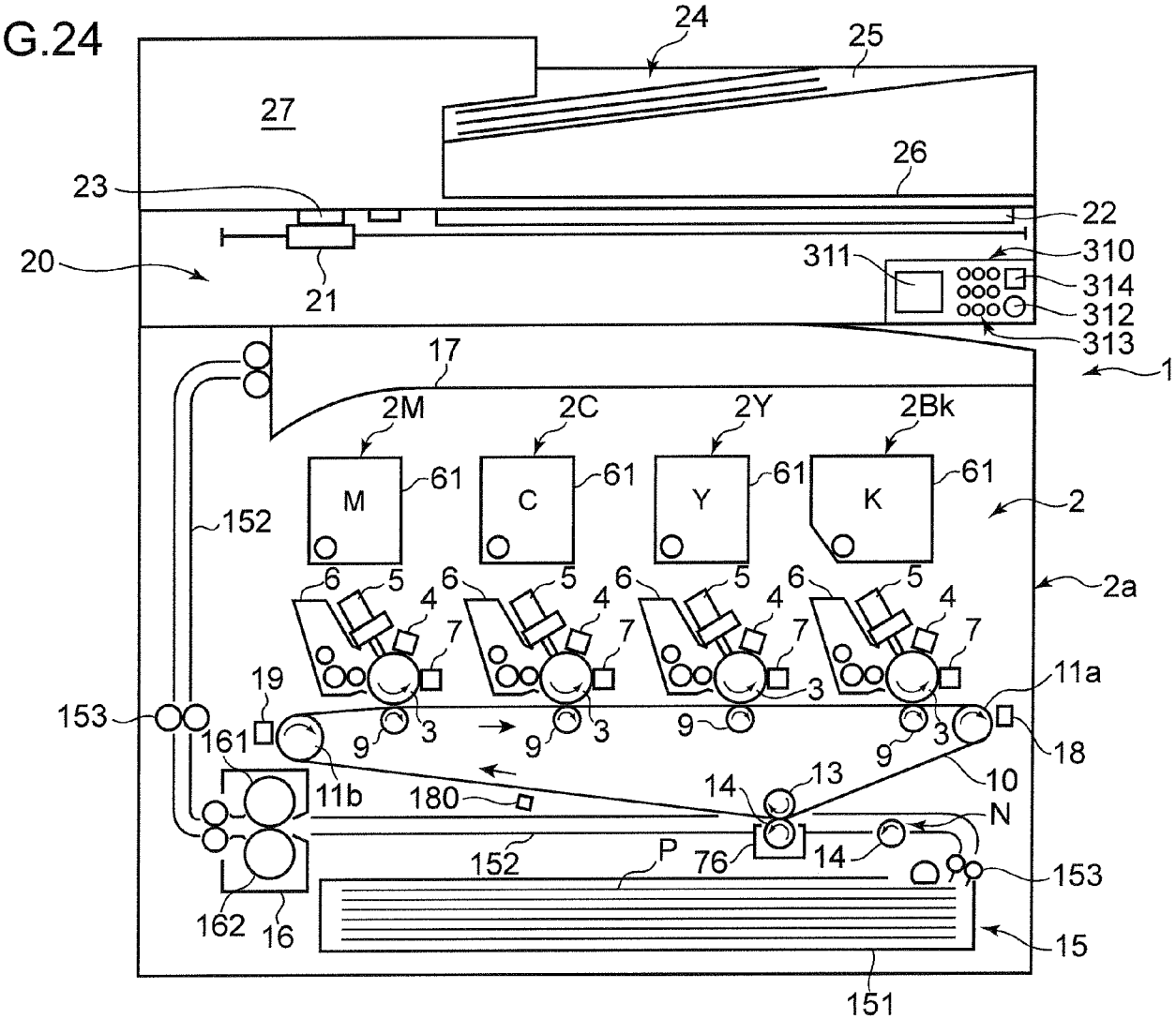
FIG. 24 is a front cross section showing the structure of a multifunction peripheral according to a modified mode of the second embodiment.

The multifunction peripheral 1 as a modified mode of the second embodiment of the image forming apparatus according to the present invention is now explained. Since the schematic configuration of the multifunction peripheral 1 as the modified mode of the second embodiment is basically the same as the multifunction peripheral 1 of the foregoing second embodiment, the explanation of the same configuration is omitted and the differences in the multifunction peripheral 1 according to the modified mode of the second embodiment are mainly explained. FIG. 24 is a schematic configuration of the multifunction peripheral 1 according to the modified mode of the second embodiment.

In this modified mode, as with the second embodiment, provided is a movement mechanism 76 for moving the secondary transfer roller 14 to a direction of coming in contact with and separating from the intermediate transfer belt 10. Details concerning the movement mechanism 76 are the same as the foregoing second embodiment, and the explanation thereof is omitted. The multifunction peripheral 1 according to the modified mode, as with the multifunction peripheral 1 of the second embodiment, determines whether the pressing state of the secondary transfer roller 14 and the intermediate transfer belt 10 is normal.

As shown in FIG. 24, an operating unit 310 is provided to the front portion of the multifunction peripheral 1 according to this modified mode as with the multifunction peripheral 1 according to the modified mode of the first embodiment. The control unit 110 of the multifunction peripheral 1 of this modified mode also comprises a time designation reception unit 113. Note that the electric schematic configuration of the multifunction peripheral 1 according to this modified mode can be represented with the same block diagram as the modified mode of the first embodiment shown in FIG. 13.

With the multifunction peripheral 1 according to this modified mode, the processing (pressing adjustment processing) of adjusting the state where the intermediate transfer belt 10 is pressed by the secondary transfer roller 14 which is moved by the movement mechanism 76 is performed as with the multifunction peripheral 1 according to the second embodiment explained with reference to FIG. 21. The timing of executing the pressing adjustment processing by the multifunction peripheral 1 according to this modified mode is set as with the multifunction peripheral 1 according to the modified mode of the first embodiment that was explained with reference to FIG. 12 to FIG. 17. Specifically, the pressing adjustment processing by the multifunction peripheral 1 according to this modified mode is executed at the timing that is set based on the processing explained with reference to FIG. 12 to FIG. 17.

Note that the movement mechanism 76, the control part 111, the determination unit 112, and the cam position detection sensor 35 in the foregoing second embodiment and its modified mode are respectively examples of the second movement mechanism, the second control part, the second determination unit, and the second pressing state detection unit referred to in the claims.

Conventionally known is an image forming apparatus of a system which temporarily transfers a toner image formed with a development unit including a photoreceptor drum to an intermediate transfer belt, and further transfers the toner image on the circumferential surface of the intermediate transfer belt onto recording paper based on a secondary transfer roller. This kind of image forming apparatus includes, for example, a movement mechanism for causing the secondary transfer roller part to be pressed against and separated from the circumferential surface of the intermediate transfer belt.

In the case of this kind of conventional image forming apparatus, even if the secondary transfer roller part and the circumferential surface of the intermediate transfer belt are of a pressed state based on the movement mechanism, there are cases where the photoreceptor drum and the circumferential surface of the intermediate transfer belt are not actually in a pressing state which is suitable for image formation due to variations in the accuracy during the assembly of the respective components configuring the image formation. Thus, there were cases where the planned image quality could not be obtained and unevenness would occur in the image quality depending on the individual image forming apparatuses.

Meanwhile, with the foregoing second embodiment, it is possible to accurately determine that the secondary transfer roller 14 is in contact with the intermediate transfer belt 10 in a normal pressing state, thereby reliably obtain the scheduled image quality, and avoid a situation where unevenness occurs in the image quality between the individual multifunction peripherals 1.

Moreover, with the multifunction peripheral 1 according to the foregoing second embodiment, in order for the determination unit 112 to determine that the pressing state of the secondary transfer roller 14 and the intermediate transfer belt 10 is normal, an additional condition is used such that the timing of detecting the concentration of the toner pattern by the concentration sensor 18 after the toner pattern is transferred from the development units 2Bk to 2M to the intermediate transfer belt 10, is delayed than the timing that the toner pattern reaches the concentration detection position of the concentration sensor 18 based on the endless traveling of the intermediate transfer belt 10, by a predetermined time required for the bidirectional toner pattern transfer between the intermediate transfer belt 10 and the secondary transfer roller 14. Accordingly, if the toner pattern transferred onto the intermediate transfer belt 10 by the development units 2Bk to 2M directly reaches the concentration detection position of the concentration sensor 18 and the concentration of the toner pattern has reached the predetermined concentration value (normal value) simply because the contact of the secondary transfer roller 14 and the intermediate transfer belt 10 is insufficient, then the pressing state of the secondary transfer roller 14 and the intermediate transfer belt is not determined to be normal. Consequently, with the multifunction peripheral 1 according to the foregoing second embodiment, the determination of whether the pressing state of the secondary transfer roller and the intermediate transfer belt is normal can be performed even more accurately.

According to the multifunction peripheral 1 of the foregoing second embodiment, since the control part 111 sets the stopped state of the movement operation by the movement mechanism 76 at the stop timing in which the pressing state is determined to be normal by the determination unit 112, as the pressing state of the secondary transfer roller 14 and the intermediate transfer belt 10 upon causing the development units 2Bk to 2M to perform image forming operation, it is possible to reliably perform normal image formation.

Moreover, with the multifunction peripheral 1 according to the foregoing second embodiment, in order for the determination unit 112 to determine that the pressing state of the secondary transfer roller 14 and the intermediate transfer belt 10 is normal, an additional condition is used such that the timing of detecting the concentration of the toner pattern by the concentration sensor 18 after the toner pattern is transferred from the development units 2Bk to 2M to the intermediate transfer belt 10, is delayed than the timing that the toner pattern reaches the concentration detection position of the concentration sensor 18 based on the endless traveling of the intermediate transfer belt 10, by a predetermined time required for the bidirectional toner pattern transfer between the intermediate transfer belt 10 and the secondary transfer roller 14. Accordingly, if the toner pattern transferred onto the intermediate transfer belt 10 by the development units 2Bk to 2M directly reaches the concentration detection position of the concentration sensor 18 and the concentration of the toner pattern has reached the predetermined concentration value (normal value) simply because the contact of the secondary transfer roller 14 and the intermediate transfer belt 10 is insufficient, then the pressing state of the secondary transfer roller 14 and the intermediate transfer belt is not determined to be normal. Consequently, with the multifunction peripheral 1 according to the foregoing second embodiment, the determination of whether the pressing state of the secondary transfer roller 14 and the intermediate transfer belt 10 is normal can be performed accurately.

Moreover, according to the multifunction peripheral 1 according to the modified example of the foregoing second embodiment, since the pressing state determination operation is executed at the timing indicated in the time designation command received by the time designation reception unit 113 from the user, it is possible to determine whether the pressing state of the secondary transfer roller 14 and the intermediate transfer belt 10 is normal at the user's intended timing.

Note that the present invention is not limited to each of the foregoing embodiments, and can be modified variously. For example, with the foregoing first embodiment and its modified mode, the multifunction peripheral 1 comprised the development units 2M, 2Y, 2C, 2Bk, and the processing of adjusting the pressing state of the intermediate transfer belt 10 and the respective photoreceptor drums 3 in the case of moving the intermediate transfer belt 10 and the respective transfer rollers 9 by the movement mechanism 100 from the position of the black-and-white image forming operation to the position of the color image forming operation during the color image forming operation was explained, without limitation thereto, the present invention can be broadly applied as the processing for adjusting the pressing of the intermediate transferring body and the photoreceptor drum (development unit) to be transfer thereby. For example, the sequential processing shown in FIG. 6 and FIG. 10 can be applied to the pressing state adjustment of the transfer belt and the photoreceptor drum for transferring the toner image to the transfer drum.

Moreover, the configuration and processing according to the embodiments shown in FIG. 1 to FIG. 24 are merely an example of the configuration and processing of the image forming apparatus according to the present invention, and do not intend to limit the configuration and processing of the image forming apparatus according to the present invention to the subject matter described above.

This application is based on Japanese Patent application Nos. 2010-123449, 2010-123450 and 2010-123451 filed in Japan Patent Office on May 28, 2010, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. An image forming apparatus, comprising:

a development unit that forms a toner image;

an intermediate transfer belt which includes a circumferential surface to which the toner image formed by the development unit is transferred and which travels endlessly by being tightly stretched across a plurality of rollers;

a transfer unit that transfers the toner image from the development unit to the intermediate transfer belt;

a secondary transfer roller part for secondarily transferring, onto recording paper, the toner image that has been transferred to the circumferential surface of the intermediate transfer belt by the development unit;

a second movement mechanism that moves the secondary transfer roller part in a direction of coming in contact with and separating from the intermediate transfer belt, and pressing the secondary transfer roller part against the intermediate transfer belt;

a toner pattern concentration detection unit that detects a concentration of a toner pattern being a concentration detection toner image that has been transferred from the development unit to the circumferential surface of the intermediate transfer belt;

a second control part that performs bidirectional toner pattern transfer control between the intermediate transfer belt and the secondary transfer roller by causing, in a state where the secondary transfer roller is pressed against the intermediate transfer belt by the second movement mechanism, the development unit to form the toner pattern and causing the transfer unit to transfer the toner pattern to the intermediate transfer belt, causing the secondary transfer roller part to transfer the toner pattern on the circumferential surface of the intermediate transfer belt to the secondary transfer roller part side, and thereafter once again transferring the toner pattern from the secondary transfer roller part to the intermediate transfer belt; and a second determination unit that determines that a pressing state of the intermediate transfer belt and the secondary transfer roller part moved by the second movement mechanism is normal when, after the toner pattern transfer control is performed by the second control part, the concentration of the toner pattern on the circumferential surface of the intermediate transfer belt detected by the toner pattern concentration detection unit has reached a predetermined concentration value.

2. The image forming apparatus according to claim 1, further comprising:

a second pressing state detection unit that detects whether the intermediate transfer belt is in a state of being pressed by the secondary transfer roller part, wherein the second control part performs sequential control operations of causing the second movement mechanism to start moving the secondary transfer roller part in a direction of coming in contact with the intermediate transfer belt, causing the second movement mechanism to stop the movement operation at a timing after a predetermined time elapses from the time that the second pressing state detection unit detects the pressing state of the intermediate transfer belt and the secondary transfer roller part, and performing, after the movement operation is stopped, the toner pattern transfer control, a plurality of times by causing the predetermined time to be different each time, and concentrations are detected by the toner pattern concentration detection unit for the toner patterns that have been transferred to the intermediate transfer belt based on the toner pattern transfer control operations that have been performed the plurality of times, the second determination unit determines a stop timing of the movement operation by the second movement mechanism in which the concentration, among these detected concentrations, shows a maximum concentration value, to be a stop timing in which the pressing state of the intermediate transfer belt and the secondary transfer roller part is normal.

3. The image forming apparatus according to claim 1, wherein, the second determination unit determines whether the concentration of the toner pattern on the circumferential surface of the intermediate transfer belt detected by the toner pattern concentration detection unit has reached a predetermined concentration value upon satisfying a condition that the timing of detecting the concentration of the toner pattern by the toner pattern concentration detection unit after the toner pattern is transferred to the intermediate transfer belt by the development unit and the transfer unit is delayed by a predetermined time required for the bidirectional toner pattern transfer between the intermediate transfer belt and the secondary transfer roller part, rather than a timing for the toner pattern to reach a concentration detection position of the toner pattern concentration detection unit based on the endless traveling of the intermediate transfer belt.

4. The image forming apparatus according to claim 1, wherein the second control part sets a stopped state of the movement operation by the second movement mechanism at the stop timing in which the pressing state is determined as normal by the second determination unit, as the pressing state of the intermediate transfer belt and the secondary transfer roller part upon causing the development unit to perform an image forming operation.

5. The image forming apparatus according to claim 1, further comprising:

a time designation reception unit that receives, from a user, a time designation command for designating a determination operation execution time of executing a pressing state determination operation including the toner pattern formation and transfer by the second control part and the determination by the second determination unit, wherein the second control part and the second determination unit execute the pressing state determination operation at the timing indicated in the time designation command received by the time designation reception unit from the user.

6. The image forming apparatus according to claim 5, wherein, upon satisfying a condition where the timing of detecting the concentration of the toner pattern by the toner pattern concentration detection unit after the toner pattern transfer control is performed by the second control part is delayed, by a predetermined time required for the bidirectional toner pattern transfer between the intermediate transfer belt and the secondary transfer roller part, than the timing that the toner pattern reaches a concentration detection position of the toner pattern concentration detection unit based on the endless traveling of the intermediate transfer belt after the toner pattern is transferred to the intermediate transfer belt by the development unit and the transfer unit, the second determination unit determines whether the concentration of the toner pattern on the circumferential surface of the intermediate transfer belt detected by the toner pattern concentration detection unit has reached a predetermined concentration value.

7. The image forming apparatus according to claim 5, wherein the time designation reception unit receives, from the user, a command to the effect of immediately executing the pressing state determination operation as the determination operation execution time.

8. The image forming apparatus according to claim 5, wherein the time designation reception unit receives, from the user, a command to the effect of periodically executing the pressing state determination operation at a predetermined timing as the determination operation execution time.

9. The image forming apparatus according to claim 8, wherein the time designation reception unit receives the determination operation execution time from the user using, as the predetermined timing, at least one among during warm-up operation of the image forming apparatus, before starting the image forming operation by the development unit, or after executing calibration.

* * * * *